US005866064A

United States Patent [19]

Teruhisa

[11] Patent Number: 5,866,064

[45] Date of Patent: Feb. 2, 1999

[54] SEALING APPARATUS FOR COMPARTMENT INLET/OUTLET OF ATMOSPHERE FACILITY

[75] Inventor: Nakamura Teruhisa, Shinnanyo, Japan

[73] Assignee: Nisshin Steel Co., Ltd., Tokyo, Japan

[21] Appl. No.: 737,797

[22] PCT Filed: Jun. 7, 1995

[86] PCT No.: PCT/JP95/01147

§ 371 Date: Dec. 18, 1996

§ 102(e) Date: Dec. 18, 1996

[87] PCT Pub. No.: WO96/33291

PCT Pub. Date: Oct. 24, 1996

[30] Foreign Application Priority Data

Apr. 18, 1995 [JP] Japan ..... 7-092890

[51] Int. Cl.[6] ..... C21D 1/74

[52] U.S. Cl. ..... 266/110; 266/103; 432/242; 432/250

[58] Field of Search ..... 266/103, 110; 432/242, 250

[56] References Cited

U.S. PATENT DOCUMENTS

| | | | |
|---|---|---|---|
| 1,829,684 | 10/1931 | Stansel | 432/250 |
| 2,367,174 | 1/1945 | Renkin | 432/242 |
| 3,291,468 | 12/1966 | Albertsen et al. | 266/110 |
| 5,658,527 | 8/1997 | Nakamura | 266/44 |

FOREIGN PATENT DOCUMENTS

| | | | |
|---|---|---|---|
| 42-18893 | 9/1942 | Japan . | |
| 47-25762 | 8/1972 | Japan . | |
| 61-153237 | 7/1986 | Japan | 266/103 |
| 61-171571 | 10/1986 | Japan . | |
| 62-214134 | 9/1987 | Japan . | |
| 62-287020 | 12/1987 | Japan . | |
| 4-4032 | 1/1992 | Japan | 266/110 |
| 6-43616 | 6/1994 | Japan . | |

OTHER PUBLICATIONS

U.S. Patent Application Ser. No. 08/592,345, filed Feb. 7, 1996, by Teruhisa Nakamura, entitled "Sealing Apparatus for Inlet/Outlet of Atmosphere Heat Treatment Furnace".

U.S. Patent Application Ser. No. 08/592,346, filed Feb. 7, 1996, by Teruhisa Nakamura, entitled "Sealing Apparatus for Inlet/Outlet of Atmosphere Facility".

*Primary Examiner*—John Sheehan
*Attorney, Agent, or Firm*—Wenderoth, Lind & Ponack, L.L.P.

[57] ABSTRACT

Elastic rotation rolls can be installed easily at optimal positions, and stable sealing performance can be attained for an extended period of time. Seal discs 47 are disposed at both ends of the roll shaft 46 of each elastic rotation roll 44 in the axial direction thereof. The outer peripheral surface of the seal disc 47 is closely contacted with the arc-shaped contact surface 52 of a sealing side wall 49 to attain sealing performance at each end face of the roll. Even if the seal disc 47 is displaced with respect to the sealing side wall 49, the sealing performance can be maintained. In this way, the structure of the sealing apparatus can be simplified and the elastic rotation rolls can be installed easily.

17 Claims, 14 Drawing Sheets

SEALING APPARATUS FOR COMPARTMENT INLET/OUTLET OF ATMOSPHERE FACILITY

BACKGROUND OF THE INVENTION

1. Field of the Invention

The present invention relates to a sealing apparatus disposed at a compartment inlet/outlet of an atmosphere facility, such as a bright annealing furnace, which performs heat treatment, such as annealing and strain relief annealing, for metal strips, such as stainless steel strips, other alloy steel strips, high-alloy strips, silicon steel strips, copper alloy strips and copper strips, without coloring or discoloring their surfaces or without generating oxide films on their surfaces.

2. Description of the Related Art

A combustible or flammable reducing atmospheric gas, such as an ammonia decomposition gas or a mixture gas of 75% of hydrogen gas and 25% of nitrogen gas, is supplied into a heat treatment furnace for annealing metal strips, such as stainless steel strips, or for strain relief annealing such metal strips to eliminate strain, without generating oxide films on their surfaces, and the pressure in the furnace is maintained about 10 to 50 mm $H_2O$ higher than the outside air.

This kind of heat treatment furnace is provided with sealing apparatuses for shutting off a metal strip passing portion at the compartment inlet and the compartment outlet so as to prevent the above-mentioned combustible or flammable gas in the furnace from leaking.

FIG. 12 is a vertical sectional view showing a schematic representation of a bright annealing furnace 3 equipped with prior art sealing apparatuses 1, 2. A metal strip 4, such as a stainless steel strip, is heat treated so as to be annealed in a reducing atmosphere formed by a mixture gas of 75% of hydrogen gas and 25% of nitrogen gas, for example, in the furnace body 5 of the vertical bright annealing furnace 3, while the pressure in the furnace is maintained about 10 to 50 mm $H_2O$ higher than the outside air. The metal strip 4 and the furnace body 5 are grounded electrically via a grounding line 6. The metal strip 4 is subjected to a surface cleaning treatment as a pretreatment before it is annealed by the bright annealing furnace 3. The direction of the metal strip 4 then changes due to a deflector roll 7 positioned at the furnace body entrance and the metal strip 4 enters the furnace body 5 from a compartment inlet 8. After the traveling direction of the metal strip 4 is reversed by a turn roll 9 in the furnace, the metal strip 4 is annealed and cooled, then delivered downward through compartment outlet 10. The direction of the metal strip 4 is changed by a deflector roll 11 at the exit and the metal strip 4 is taken up on a tension reel.

In this kind of bright annealing furnace 3, the metal strips 4, such as stainless steel strips, other alloy steel strips, high-alloy strips, copper alloy strips and copper strips, are annealed continuously while preventing oxidation. It is therefore very important to seal a furnace gas 5*a* at the compartment inlet 8 and the compartment outlet 10 while the metal strip 4 is passed through so as to ensure the quality of products and the safety of furnace operation. In order to provide the necessary sealing, the above-mentioned sealing apparatuses 1, 2 are provided.

FIG. 13 is a partial front view showing the structure of the sealing apparatus 2 disposed at the compartment outlet 10 shown in FIG. 12, and FIG. 14 is a side view of the sealing apparatus 2. This prior art is disclosed in Japanese Examined Patent Publication JP(B2) 42-18893 (1967), for example. Since the structure of the sealing apparatus 1 disposed at the compartment inlet 8 is similar to that of the sealing apparatus 2 disposed at the compartment outlet 10, the structure of the sealing apparatus 1 is not described here to avoid overlaps. In the above-mentioned sealing apparatus 2, a pair of elastic rotation rolls 16, the outer peripheral portions of which are made of an elastic material such as rubber, are pushed against the metal strip 4 and a pair of elastic pads 17 by the action force of a roll open/close device 18 so as to seal the boundary between each elastic rotation roll 16 and the metal strip 4 and the boundary between each elastic rotation roll 16 and each elastic pad 17.

The elastic pads 17 are secured to the surfaces of sealing fixtures 19 respectively, and each sealing fixture 19 is secured to the furnace body 5. In the roll open/close device 18, levers 20 are swivelably mounted on fixing pins 21 which are used as the rotation centers of the levers. A bearing 28 for supporting a roll shaft 22 of the elastic rotation roll 16 is disposed at one end of each lever 20. The other end of each lever 20 is connected to an end of a link member 23 via a pin 24. The other end of each link member 23 is connected to a piston rod 27 of a cylinder 26 via a pin 25.

As shown in FIG. 14, when the piston rod 27 is retracted, the elastic rotation rolls 16 are brought close to each other to sandwich the metal strip 4. Furthermore, the elastic rotation rolls 16 are pushed against the elastic pads 17. Consequently, sealing is performed at the contact position between each elastic rotation roll 16 and the metal strip 4 and at the contact position between each elastic rotation roll 16 and each elastic pad 17.

Both ends of each roll shaft 22 in the axial direction thereof are inserted into the cutouts 30 of side walls 29 secured to the furnace body 5 and rotatably supported around the axis of the roll shaft 22 by bearings 28 disposed at one end of each lever 20. On each roll shaft 22, a roll covering 31, the outer peripheral portion of which is made of an elastic material such as rubber as described above, is provided coaxially. Three washers 32, 33, 34 are interposed between one end face of the roll covering 31 in the axial direction thereof and the inner surface of one side wall 29 facing the end face, and are also interposed between the other end face of the roll covering 31 in the axial direction thereof and the inner surface of the other side wall 29 facing the other end face. Among the three washers 32 to 34, the washer 32 disposed closest to the end face of the roll covering 31 is made of expanded-sponge-like neoprene rubber. The central washer 33 contacting the washer 32 is made of fluororesin having a low coefficient of friction, such as polytetrafluoroethylene resin (PTFE). The washer 34 disposed nearest to the side wall 29 is made of carbon steel, stainless steel or non-ferrous metal.

As described above, the prior art disclosed in Japanese Examined Patent Publication JP(B2) 42-18893 (1967) uses three washers 32 to 34 to prevent each elastic rotation roll 16 from contacting the side wall 29 during passing of a metal strip and to seal the end faces of the rolls.

In this kind of prior art, the side walls 29 are disposed on both sides of each elastic rotation roll 16 in the axial direction thereof. The three washers 32 to 34 are interposed between the side wall 29 and the roll covering 31 on each side of the elastic rotation roll 16. In this prior art arrangement, in order to seal clearances between the side wall 29 and the end face of the elastic rotation roll 16 and the respective washers by an appropriate repulsion force generated by the washer 32, the washer 32 is required to be formed so as to have a thickness slightly larger than the dimension obtained by subtracting the thicknesses of the washers 33 and 34 from the clearance between the roll covering 31 and the side wall 29, taking into account of the shrinkage allowance of the washer 32. Furthermore, the elastic rotation roll 16 is required to be positioned and installed accurately so that the clearance between the end face of the roll covering 31 and the inner surface of the side wall 29 secured to the furnace body 5 on one side of the roll covering 31 is equal to the corresponding clearance on the other side of the roll covering 31. In case the clearance on one side or the clearances on both sides are more narrow than necessary at this time, a pushing force is applied to the side wall 29 by the repulsion force of the washer 32 and the rotation resistance of the elastic rotation roll 16 increases. Even when the elastic rotation roll 16 is positioned so as to have equal clearances on the right and left sides thereof, each of the elastic rotation rolls 16, sandwiching the metal strip 4, is always subjected to a thrust force in the axial direction due to a repulsion force caused by the snaking of the metal strip 4, because the metal strip 4 does not travel straight but slightly snakes repeatedly when the metal strip 4 is passed through the sealing apparatuses 1, 2 having the above-mentioned structure. In addition, the bearing 28 has play in the axial direction as a relief allowance for the thermal expansion of the roll shaft 22 so as to allow the elastic rotation roll 16 to move by a fraction of 1 mm. Therefore, the pushing force of the washer 32 against the secured side wall 29 changes at all times, and the rotation resistance also changes accordingly.

Furthermore, when the axial length of each elastic rotation roll 16 is changed because of thermal expansion, when the rubber washer 32 expands, shrinks, or changes in hardness or elastic force because of a temperature change, or when the washers 32 to 34 change in thickness because of partial wear, the pushing force against the roll covering 31 cannot be corrected to an appropriate value automatically, because the inner dimension between the side walls 29 of the sealing apparatus is determined and the axial position of the elastic rotation roll 16 is also determined. This causes the problem of being unable to offer a stable sealing effect for an extended period of time. Moreover, when one of the three washers 32 to 34 is required to be replaced because of deformation due to wear or heat generation or because of a change in rotation resistance due to attached abrasion powder or the like, the entire production line must be stopped and the elastic rotation roll 16 must be removed. In this way, the replacement of the washers 32 to 34 is troublesome.

Additionally, to adjust the pushing force against the roll covering 31 by the washers 32 to 34, the washers 32 to 34 must be replaced with those having different thicknesses. In the case of this kind of adjustment of the pushing force, since the elastic rotation roll 16 must be removed, a process line must be stopped, thereby causing the problem of reducing productivity.

Moreover, in the prior art arrangement, wear occurs at the metallic washer 34, which is pushed against the side wall 29, and the metallic roll shaft 22, which rotates, due to the metallic contact between the inner diameter portion of the washer 34 and the roll shaft. When the mutual contact pressure among the washers 32 to 34 is raised for increasing sealing performance, the sliding friction among the washers 32 to 34 increases, the rotation torque of the elastic rotation roll 16 is not completely isolated but is transmitted to the metallic washer 34, and wear occurs due to metallic contact between the washer 34 and the side wall 29, thereby causing the problem of reduced sealing performance due to attachment of dirt, caused by generated metal powder, to the metal strip 4, and due to damage or wear of the metal material for the side wall 29, the washer 34 and the roll shaft 22. To the contrary, when the contact pressure among the washers 32 to 34 is reduced, the above-mentioned friction can be reduced, thereby preventing the generation of metal powder and wear. However, the sealing performance is lowered. In this way, a conflicting problem occurs. In particular, when the metal strip 4 is passed through at high speed, the washers 32 to 34 tend to experience significant wear and they must be replaced frequently, thereby causing the problem of being unable to carry out stable operation for an extended period of time.

Furthermore, in case the covering 31 of the elastic rotation roll 16 is an insulator, static electricity is generated by the deformation or separation of the covering 31 due to continuous pushing and rotation during operation, or by repeated friction with the elastic pad 17. Since the atmospheric gas in the furnace leaks in the vicinities of the sealing apparatuses 1, 2, and the vicinities, having a dew point of about −50° C. are very dry, the electrification potential amounts up to ±5000 V to 15000 V. Therefore, in case the static electricity causes sparks to adjacent metal parts, a fire may be caused easily or sometimes an explosion may occur.

Accordingly, the purpose of the present invention is to provide a sealing apparatus for a compartment inlet/outlet of an atmosphere facility, in which stable operation can be performed for an extended period of time. Also, the safety of operation is enhanced by preventing ignition due to sparks caused by static electricity, the installation position of each elastic rotation roll can be adjusted easily without removing the elastic rotation roll 16, that is, with the atmospheric gas remaining supplied, and each elastic rotation roll can be installed easily and accurately at the optimal position without requiring skills.

DISCLOSURE OF THE INVENTION

The present invention discloses a sealing apparatus for a compartment inlet/outlet of an atmosphere facility, disposed in at least one of an inlet and an outlet of a compartment of a furnace body for atmosphere-treating a metal strip continuously passed through a furnace by using an atmospheric gas, and equipped with a pair of elastic rotation rolls and a pair of elastic pads pushed against the elastic rotation rolls from the inside of the furnace over the entire lengths of the elastic rotation rolls in the axial direction thereof.

The apparatus includes seal discs coaxially mounted at both ends of a roll shaft of each elastic rotation roll in the axial direction of the roll shaft via bearings, the seal discs holding ring-shaped or hollow cylindrical elastic bodies.

Means are provided for isolating the rotation of the elastic rotation rolls so as not to transmit the rotation torque of the elastic rotation rolls to the seal discs. The means are disposed between the ends of each elastic rotation roll body portion and each pair of seal discs.

A pair of sealing side walls contact the outer peripheral surfaces of the elastic bodies of each pair of the seal discs in the range from a mutual contact position between the outer peripheries of the elastic bodies of each pair of the seal discs facing each other to contact positions between the elastic bodies of each pair of seal discs and each elastic pad so as to seal the boundaries between the outer peripheral surfaces of the elastic bodies of the seal discs and the furnace body.

The invention is characterized in that at both ends of the roll shaft of each elastic rotation roll in the axial direction of the roll shaft are provided with means for axially adjusting positions of the pair of seal discs, and pushing devices for elastically adjusting pushing forces in mutually approaching directions.

Furthermore the invention is characterized in that the pushing device comprises:

a spring mounted at each end of the roll shaft of each elastic rotation roll in the axial direction of the roll shaft;

a threaded cylindrical body having an outer thread on the outer periphery thereof and mounted at each end of the roll shaft in the axial direction thereof from the outside of each seal disc; and a nut screwed on the threaded cylindrical body, for supporting the spring.

Furthermore the invention is characterized in that the elastic body of each seal disc is made of one or plural kinds of elastic bodies selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethlene, butadiene rubber, acrylic rubber and hydrin rubber, and has a hardness in the range of 40° to 90° as a value specified in JIS K 6301 A.

Furthermore the invention is characterized in that the elastic body of each seal disc is selected so as to have an axial length which is larger, in at least an axially inward direction, than the width of the sealing side walls along the axial direction of the seal disc.

Furthermore the invention is characterized in that the elastic body used as a covering member of each elastic rotation roll is made of one or plural kinds of elastic bodies selected from among natural rubber, isoprene rubber, SBR, NBR, CR, butyl rubber, polysulfide rubber, silicone rubber, fluororubber, urethane rubber, chlorosulfonated polyethylene, chlorinated polyethylene, butadiene rubber, EPDM, acrylic rubber and hydrin rubber, and has a hardness in the range of 40° to 90° as a value specified in JIS K 6301 A.

Furthermore the invention is characterized in that each elastic rotation roll is integrally formed by cylindrically coating the outer peripheral surface of the roll shaft with an elastic body, at least the outer surface of which has a specific electric resistance in the range of 1 to $10^7$ Ω·cm, in the longitudinal direction of the outer peripheral surface of the roll shaft.

Furthermore the invention is characterized in that the elastic body used as a covering member of the elastic rotation roll is integrally formed on the outer peripheral surface of the roll shaft by stacking a plurality of nonwoven fabric discs or by spirally winding and overlaying a long nonwoven fabric band on the outer peripheral surface of the roll shaft in the longitudinal direction thereof.

Also, a flange is provided on each end face of the roll shaft.

After stacking a plurality of nonwoven fabric discs between the flanges or spirally winding and overlaying a long nonwoven fabric band, the flanges are pushed in the longitudinal direction of the roll shaft so as to narrow the distance between the flanges, thereby integrating and securing the stacked nonwoven fabric discs or the overlaid nonwoven fabric band.

A cylindrical cover coated with an elastic body is provided for covering the outsides of the flanges. The outer diameter of the cover is the same as that of the body of the elastic rotation roll, and is provided such that the axially outward ends of the cover fit on the roll shaft of the elastic rotation roll and the axially inward ends of the cover contact the flanges.

Also, the axially outward ends of the cover are coated or not coated with an elastic body.

Furthermore the invention is characterized in that the nonwoven fabric used as the covering member of the elastic rotation roll is a nonwoven fabric including fibers mixed with carbon, or a nonwoven fabric using fibers made by chemically forming polypyrrole which is an electron-conjugated conductive polymer, or a nonwoven fabric using fibers produced by treating acrylic fibers with a compound including a divalent copper compound and sulfur, each being a conductive nonwoven fabric having a specific electric resistance in the range of 1 to $10^7$ Ω·cm.

Furthermore the invention is characterized in that rotation discs are provided between the ends of the body of the elastic rotation roll and the seal discs, each rotation disc comprising:

an outer covering member made of an elastic material and disposed at each end of the elastic rotation roll, the outer covering member having a first flange portion contacting the end face of the elastic rotation roll and a first cylindrical portion extending outward in the axial direction of the elastic rotation roll from the outer peripheral portion of the first flange portion;

a first supporting member made of a rigid material and disposed at each end of the elastic rotation roll, the first supporting member having a second flange portion contacting the outer surface of the first flange portion and a second cylindrical portion extending outward in the axial direction of the elastic rotation roll from the outer peripheral portion of the second flange portion;

a second supporting member made of a rigid material and disposed at each end of the elastic rotation roll, the second supporting member having a third cylindrical portion interposed between the roll shaft of the elastic rotation roll and the second cylindrical portion outside in the axial direction of the elastic rotation roll from the second flange portion and a third flange portion extending in the radial direction of the elastic rotation roll from the axially outward end face of the third cylindrical portion;

an outer bearing disposed at each end of the elastic rotation roll, interposed between the third cylindrical portion and the second cylindrical portion, the outer bearing receiving radial and thrust forces;

an inner bearings disposed at each end of the elastic rotation roll and interposed between the third cylindrical portion and the roll shaft of the elastic rotation roll; and an end face sealing member made of an elastic material, disposed at each end of the elastic rotation roll and interposed between the seal disc and the third flange portion of the second supporting member of the rotation disc.

Furthermore the invention is characterized in that an inclined face is formed on the outer periphery of the third flange portion of the second supporting member of the rotation disc so that the diameter of the third flange portion decreases outward in the axial direction of the elastic rotation roll.

Furthermore the invention is characterized in that the outer covering member and the end face sealing member of the rotation disc are made of an elastic body having a specific electric resistance in the range of 1 to $10^7$ Ω·cm.

Furthermore the invention is characterized in that the elastic pad is made of a nonwoven fabric in at least a surface layer portion contacting the elastic rotation roll, and is an elastic body as a whole, having a hardness in the range of 10° to 50° as a value specified in JIS S 6050.

Furthermore the invention is characterized in that the elastic pad has a specific electric resistance in the range of $10^{-3}$ to $10^{7}$ Ω·cm in at least a surface layer portion contacting the elastic rotation roll.

Furthermore the invention is characterized in that the elastic pad is made of a material having an LOI value of 26 or more in at least a surface layer portion contacting the elastic rotation roll, LOI being a limit oxygen index, that is, an index of the minimum oxygen volume percentage required for maintaining combustion of fibers.

In accordance with the invention, the sealing apparatus is disposed at least at a compartment inlet in which a metal strip to be atmosphere-treated in a furnace is inserted or at a compartment outlet from which the metal strip having been atmosphere-treated is discharged. The sealing apparatus comprises a pair of elastic rotation rolls for sandwiching a metal strip on both sides in the thickness direction thereof, a pair of elastic pads pushed against the elastic rotation rolls over the entire lengths of the rolls in the axial direction of the roll shaft, a pair of rotation discs or slip discs disposed between the seal discs and both ends of the roll shaft of each elastic rotation roll in the axial direction of the roll shaft, and a pair of sealing side walls contacting the outer peripheral surfaces of the elastic bodies of each pair of the seal discs in the range from the mutual contact positions between the outer peripheries of the elastic bodies of each pair of the seal discs to the contact positions where the elastic bodies of each pair of the seal discs contact each elastic pad so as to seal the boundaries between the furnace body and the outer peripheral surfaces of the elastic bodies of the seal discs.

With this structure, unlike the prior art, it is not necessary to provide sealing side walls positioned at both ends of the elastic rotation roll. Therefore, even when the total thickness of washers is larger than the clearance dimension for the washers provided between the side wall and the end of the elastic rotation roll, or even when a thrust force is generated by the thermal expansion of the elastic rotation roll or by the snaking of the metal strip, the rotation of the elastic rotation roll is not braked by the friction between the washers, by the friction between the end face of the elastic rotation roll and the washer facing the end face, and by the friction between the side wall and the washer facing the side wall. In addition, even when the length of the elastic rotation roll is changed in the axial direction thereof by the thermal expansion of the elastic rotation roll, or even when the hardness and elasticity of each washer are changed by an increase in temperature, these changes are made allowable by the expansion/contraction of a spring used to hold the seal disc. Therefore, a stable and constant sealing effect can be obtained for an extended period of time.

Furthermore, since each seal disc is mounted on the roll shaft via means for isolation, such as bearings, the rotation of the roll shaft of the elastic rotation roll can be prevented from being transmitted to the seal disc, thereby being capable of eliminating braking and wear caused by the contact of the seal disc with the sealing side wall, and capable of obtaining a stable and constant sealing effect for an extended period of time.

Furthermore, since sealing at both ends of each elastic rotation roll is performed by the contact between the outer peripheral surface of the elastic body of the seal disc and the inner peripheral portion of the arc-shaped cutout of the sealing side wall, as long as the contact is attained in the range of the thickness of the elastic body in the axial direction thereof, the sealing function can be ensured even when the elastic rotation roll is axially displaced. Unlike the prior art, when each elastic rotation roll is installed on the frame or the like provided at the compartment inlet and the compartment outlet of the furnace body, the roll is not required to be positioned accurately within a predetermined inside dimension between the side walls so that the clearance between the one end of the elastic rotation roll and the side wall is equal to the clearance between the other end of the roll and the side wall. Therefore, the elastic rotation roll can be positioned easily at the optimal position without requiring skills.

Furthermore, in accordance with the invention, pushing devices are disposed at both ends of the roll shaft of end elastic rotation roll in the axial direction of the roll shaft to push and adjust each pair of the seal discs so as to come closer to each other. By the snaking of the metal strip, or the like, even when each roll shaft is slightly displaced to one side in the axial direction thereof against the friction forces generated at the contact surfaces between the outer peripheral surfaces of the elastic bodies of the seal discs and the inner peripheral portions of the arc-shaped cutouts of the sealing side walls, that is, even when each elastic rotation roll is displaced, each pushing device pushes each seal disc in the direction of the displacement so that each seal disc is integrated with the elastic rotation roll, while maintaining a constant pushing force without damaging the sealing performance, thereby being capable of disposing an integrated set comprising the elastic rotation roll including the seal discs and the rotation discs or the slip discs at the optimal position suited for the sealing purpose at all times.

Furthermore, in accordance with the invention, the pushing device includes a spring mounted at each end of the roll shaft in the axial direction thereof, a threaded cylindrical body mounted with a bolt outside the spring in the axial direction of the roll shaft and a nut screwed on the threaded cylindrical body. With this structure, the threaded cylindrical body is moved along the roll shaft in the axial direction thereof so as to roughly position the seal disc with respect to the elastic rotation roll, then the threaded cylindrical body is secured with the bolt. In addition, the nut is moved forward or backward along the threaded cylindrical body so as to accurately position the seal disc and to apply a suitable pushing force to the seal disc, thereby being capable of performing fine adjustment. In this way, the seal disc can be positioned easily with respect to the elastic rotation roll.

Furthermore, in accordance with the invention, since the elastic body of the seal disc is made of one or plural kinds of elastic bodies selected from among silicone rubber, fluororubber, chloroprene rubber, SBR, NBR, EPDM, urethane rubber, isoprene rubber, butyl rubber, polysulfide rubber, chlorosulfonated polyethylene, chlorinated polyethylene, butadiene rubber, acrylic rubber and hydrin rubber, and has a hardness in the range of 40° to 90° as a value specified in JIS K 6301 A, the seal disc has elasticity suited for sealing. In addition, since the seal disc has no ventilating characteristic, the seal disc can sufficiently shut off the furnace gas from the outside air when closely contacted with the contact surface of the sealing side wall. The seal disc also has wear resistance and durability. For these reasons, a stable sealing effect can be obtained for an extended period of time. Accordingly, even when the sandwiching force of the elastic rotation rolls is changed by roll open/close devices for the elastic rotation rolls while the seal discs are in close contact with the contact surfaces of the sealing side walls, the seal discs can follow the open/close movement of the elastic rotation rolls without affecting the sealing performance of the elastic rotation rolls, because the elastic bodies of the seal discs are deformed just as the elastic bodies of the elastic rotation rolls are deformed. Consequently, excellent sealing performance can be ensured.

Furthermore, in accordance with the invention, since the axial length of the seal disc is made larger than the width of the sealing side wall along the axial direction of the seal disc, even when the axial length of the seal disc is changed because of the snaking of the metal strip or the thermal expansion of the rotation discs or slip discs and seal discs, or even when the axial position of the seal disc is shifted by the adjustment after the elastic rotation roll is installed, the outer peripheral surface of the seal disc and the sealing side wall have a continuous and constant effective contact surface at all times, thereby maintaining the sealing effect.

Furthermore, in accordance with the invention, since the elastic rotation roll is integrally formed by cylindrically coating the peripheral surface of the roll shaft with an elastic body, at least the surface layer portion of which has a specific electric resistance in the range of 1 to $10^7$ Ω·cm, in the longitudinal direction of the outer peripheral surface of the roll shaft, even when static electricity is generated because of deformation or separation caused by the continuous rotation of the elastic rotation roll or because of continuous friction between the elastic rotation roll and the elastic pad, spark discharge does not occur, thereby enhancing the safety of operation.

Furthermore, in accordance with the invention, the elastic body used as the covering member of the elastic rotation roll is made of one or plural kinds of elastic bodies selected from among natural rubber, isoprene rubber, SBR, NBR, CR, butyl rubber, polysulfide rubber, silicone rubber, fluororubber, urethane rubber, chlorosulfonated polyethylene, chlorinated polyethylene, butadiene rubber, EPDM, acrylic rubber and hydrin rubber, and has a hardness in the range of 40° to 90° as a value specified in JIS K 6301 A. Therefore, the elastic body delivers an appropriate elastic repulsion force, has a large coefficient of friction, and does not cause a slip. In addition, the elastic body does not generate any clearance which might be caused in case an improper elastic body is used and deformed by the edges of the metal strip and surrounds the edges. Therefore, the elastic body of the invention can be in close contact with the surface of the metal strip being passed through continuously to sufficiently shut off the furnace gas from the outside air. Furthermore, since the elastic body has wear resistance and durability, even when foreign matter enters between the metal strip and the elastic body, the elastic body is dented and no pressure mark is made on the metal strip. Consequently, the quality of the metal strip can be enhanced since stable heat treatment can be performed without causing problems.

Furthermore, in accordance with the invention, the elastic rotation roll is integrally formed by stacking a plurality of nonwoven fabric discs or by spirally winding and overlaying a long nonwoven fabric band on the outer peripheral surface of the roll shaft in the longitudinal direction thereof. A flange is provided on each end face of the roll shaft. The plurality of nonwoven fabric discs are stacked or the long nonwoven fabric band is spirally wound and overlaid between the flanges and then the flanges are pushed in the longitudinal direction of the roll shaft by means of nuts etc. so as to narrow the distance between the flanges, thereby integrating and securing the stacked nonwoven fabric discs or the overlaid nonwoven fabric band. A cylindrical cover coated with an elastic body, for covering the outside of the flange, the outer diameter of the cover being the same as that of the body portion of the elastic rotation roll, is fitted on the roll shaft, and the axially inward end of the cover contacts the flange. Also, the axially outward end of the cover is coated or not coated with an elastic body. In this way, the roll body portion of the elastic rotation roll is made of a nonwoven fabric, and the coefficient of dynamic friction of the nonwoven fabric is larger than that of rubber. Although the coefficient of dynamic friction of rubber covering against the metal strip is generally about 0.19, the coefficient of dynamic friction of a nonwoven fabric against that is about 0.24 to 0.28. Therefore, the nonwoven fabric hardly slips. Even when foreign matter enters between the metal strip and the nonwoven fabric, the nonwoven fabric is effective in allowing the foreign matter to sink inside. Because of these reasons, even when the nonwoven fabric contacts the surface of the metal strip, there is no fear of scratching the surface of the metal strip. Therefore, the roll body portion made of the nonwoven fabric can be in close contact with the surface of the metal strip being passed through continuously, thereby being capable of sufficiently shutting off the furnace gas from the outside air.

Furthermore, in accordance with the invention, the nonwoven fabric used as the covering member of the elastic rotation roll is a nonwoven fabric including fibers mixed with carbon, or a nonwoven fabric using fibers made by chemically forming polypyrrole, electron-conjugated conductive polymer, or a nonwoven fabric using fibers produced by treating acrylic fibers with a compound including a divalent copper compound and sulfur, each being a conductive nonwoven fabric having a specific electric resistance in the range of 1 to $10^7$ Ω·cm. Therefore, even when static electricity is generated on the surface of the elastic rotation roll made of the nonwoven fabric, the potential of the static electricity does not rise up to a voltage level at which spark discharge is apt to occur, thereby enhancing the safety of operation.

Furthermore, in accordance with the invention, rotation discs can be provided as means for sealing the roll body ends of the elastic rotation roll and for isolating the rotation of the elastic rotation roll so that the rotation torque of the elastic rotation roll is not transmitted to the seal discs. To seal each end of the elastic rotation roll, an outer covering member made of a material having elasticity and supported by the first supporting member, and an end face sealing member at least the outer peripheral portion of which is made of a material having elasticity are provided. The outer covering member supported by the first supporting member rotates together with the roll body, and the tip of the first cylindrical portion of the outer covering member contacts the elastic portion of the axially inward portion of the end face sealing member and the axially inward outer peripheral portion of the flange portion of the second supporting member while sliding to perform sealing. The first supporting member is made of a rigid material, and rotated together with the roll body while the second flange portion thereof is contacted with the outer surface of the first flange portion of the outer covering member. A radial force is transmitted from the second cylindrical portion of the first supporting member to the third cylindrical portion of the second supporting member via an outer bearing. A thrust force is also transmitted to the third cylindrical portion of the second supporting member via the outer bearing. The thrust force transmitted to the second supporting member is received by the end face sealing member via the third flange portion of the second supporting member. The radial force transmitted to the second supporting member is received by the roll shaft of the elastic rotation roll via inner bearings which may be subjected to the thrust force. In this way, the materials having elasticity are closely contacted with each other at both ends of the roll body to ensure the sealing performance. On the other hand, since the loads due to the radial and thrust forces generated by rotation are reduced by providing the outer and inner bearings, the metal strip and the elastic rotation rolls can be pushed sufficiently and closely contacted with one another while the elastic rotation rolls are rotated smoothly. In other words, close contact is established between each end of the roll body in the axial direction thereof and the outer covering member, between the end face sealing member and the seal disc, and between the seal disc and the sealing side wall, thereby ensuring sealing. In addition, by shutting off the transmission of the rotation force of each elastic rotation roll to the sealing side wall by means of the rotation disc or the slip disc, the rotation load of the elastic rotation roll can be also reduced.

Furthermore, in accordance with the invention, since at least the outer peripheral portion of the elastic rotation roll has a specific electric resistance in the range of 1 to $10^7$ Ω·cm, even when static electricity is generated, the potential of the static electricity does not rise up to a voltage level at which spark discharge is apt to occur, thereby enhancing the safety of operation.

Furthermore, in accordance with the invention, since an inclined face is formed on the third flange portion of the second supporting member so that the diameter of the third flange portion is reduced outwardly in the axial direction of the roll body, the elastic material of the end face sealing member can be integrally formed up to the thin wall portion of the outer peripheral tip of the flange portion, and the outer diameter of the flange portion opposite to the tip of the outer covering member can be made as large as the outer discharge of the sliding ring. The outer peripheral portion of the end face sealing member made of an elastic material is pushed and enters the space formed by the sliding rings, the end faces of the outer covering members and the thin wall portions of the outer peripheral tips of the flange portions of the end face sealing members of the opposed elastic rotation rolls, thereby being capable of attaining high sealing performance.

Furthermore, in accordance with the invention, since the outer covering member and the end face sealing member of the rotation disc have a specific electric resistance in the range of 1 to $10^7$ Ω·cm, even when static electricity is apt to be generated because of separation or deformation caused by the rotation between the rotation discs and between the end face sealing members of the elastic rotation rolls facing each other, or even when continuous sliding friction occurs between the elastic rotation rolls and the elastic pads, electrification due to static electricity can be prevented and the spark discharge can be restricted.

Furthermore, in accordance with the invention, since the elastic pad, at least the surface layer portion thereof contacting the elastic rotation roll, is made of a nonwoven fabric, and the elastic pad is as a whole an elastic body having a hardness in the range of 10° to 50° as a value specified in JIS S 6050, the elastic pad is pushed uniformly over the entire surface because of its appropriate flexibility, and fits well with the uneven surface of the elastic rotation roll, thereby being capable of ensuring high sealing performance without damaging the surface of the elastic rotation roll.

Furthermore, in accordance with the invention, since the elastic pad, at least the surface layer portion thereof contacting the elastic rotation roll, has a specific electric resistance in the range of $10^{-3}$ to $10^7$ Ω·cm, even when static electricity is generated by friction, deformation or separation of the covering due to the contact between the elastic rotation rolls during rotation or by friction between the elastic rotation roll and the elastic pad, spark discharge does not occur, and electrification is prevented by grounding or corona discharge from the tips of fibers, thereby being capable of preventing fires and explosions.

Furthermore, in accordance with the invention, since the elastic pad, at least the surface layer portion thereof contacting the elastic rotation roll, is made of a material having an LOI value, a limit oxygen index (an index of the minimum oxygen volume percentage required for maintaining combustion of fibers) value, of 26 or more, in case a fire occurs at the sealing portion and the fire is extinguished in a short time, the material does not melt or drop, and does not burn continuously because of its self-extinguishing characteristic. Consequently, the sealing performance is not lowered and operation can be resumed immediately.

BEST MODE FOR EMBODYING THE INVENTION

Figure 1:
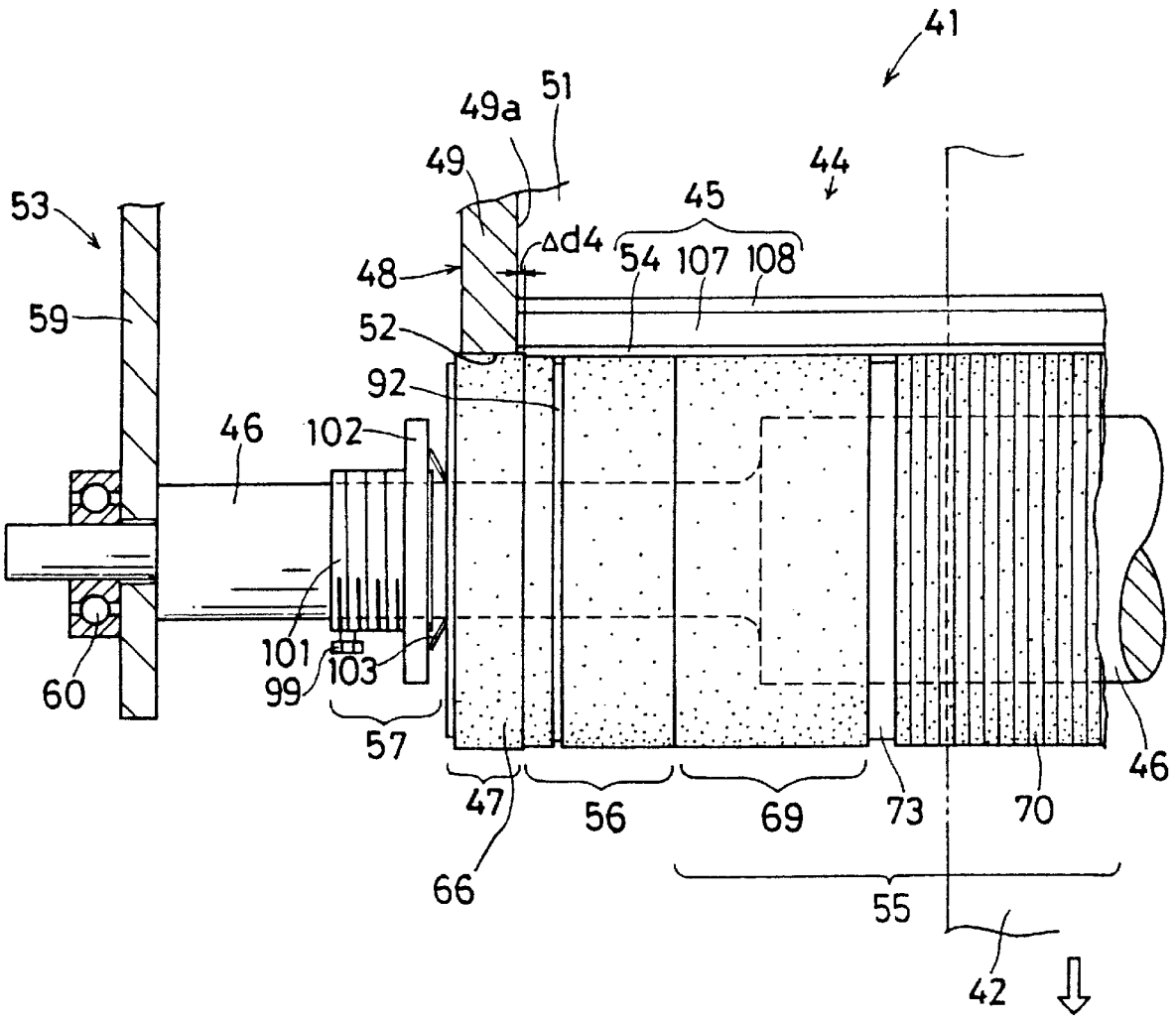
FIG. 1 is a partial enlarged front view showing a sealing apparatus in accordance with an embodiment of the present invention.
Figure 2:
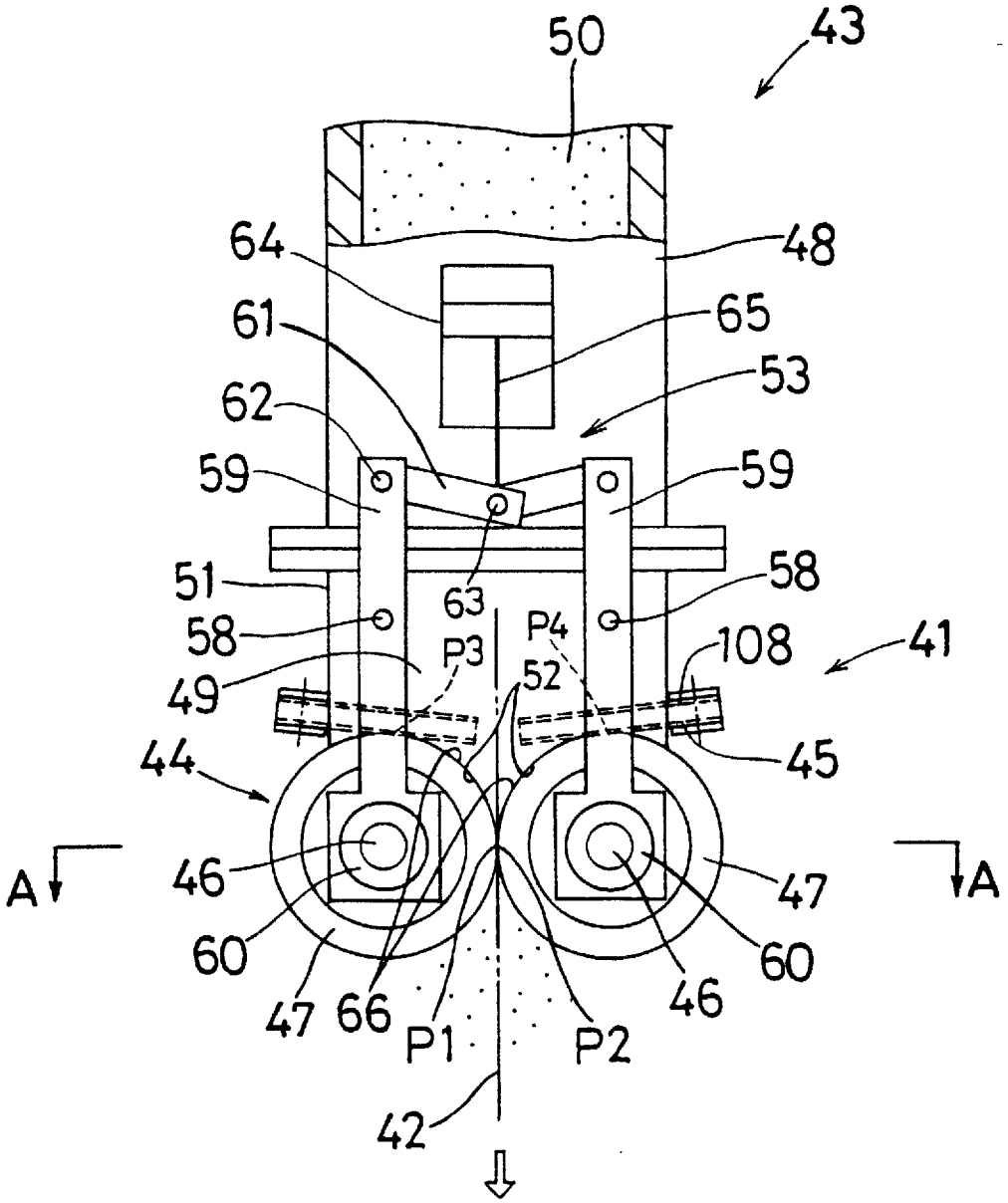
FIG. 2 is a left side view showing the sealing apparatus of FIG. 1.

FIG. 1 is a sectional view showing a sealing apparatus 41 in accordance with an embodiment of the present invention, and FIG. 2 is a schematic left side view showing the sealing apparatus 41 of FIG. 1. The sealing apparatus 41 of this embodiment is disposed at a compartment inlet through which a metal strip 42 enters a bright annealing furnace 43, that is, an atmosphere facility, and at a compartment outlet through which the metal strip 42 being subjected to atmosphere treatment is delivered from the bright annealing furnace 43. This kind of sealing apparatus 41 includes a pair of elastic rotation rolls 44 for sandwiching the metal strip 42 on both sides in the thickness direction thereof, a pair of elastic pads 45 pushed against the elastic rotation rolls 44 from the inside of the furnace over the entire axial lengths of the elastic rotation rolls 44, a pair of seal discs 47 coaxially disposed at both ends of a roll shaft 46 of each elastic rotation roll 44 in the axial direction thereof, and a pair of sealing side walls 49 having arc-shaped contact surfaces 52 for contacting the right cylindrical outer peripheral surfaces 66 of each pair of seal discs 47 in the range from the mutual contact positions P1, P2 between each pair of rotation discs 56 and between each pair of seal discs 47 to the contact positions P3, P4 between each pair of seal discs 47 and each elastic pad 45.

Combustible or flammable furnace gas 50 is supplied to a furnace body 48, and the pressure in the furnace is maintained at about 10 to 50 mm $H_2O$ higher than the outside air. A frame 51 constituting the compartment inlet and outlet including the sealing side walls 49 of the furnace body 48 is provided with a roll open/close device 53 capable of moving the elastic rotation rolls 44 to a position wherein the rolls are pushed against the metal strip 42 and to another position wherein the rolls are away from the metal strip 42.

The elastic rotation roll 44 includes a roll body 55, the rotation discs 56 disposed at both ends of the roll body 55 in the axial direction thereof, the seal discs 47 disposed axially outward (leftward in FIG. 1) from the rotation discs 56, and pushing devices 57 for elastically pushing the seal discs 47 axially inward (rightward in FIG. 1).

In the roll open/close device 53, the roll shafts 46 of the elastic rotation rolls 44 are supported at the lower ends of arms 59 swivelably mounted on fixing pins 58 which are used as the centers of rotation. Bearings 60 are provided to receive radial and thrust forces. The upper ends of the arms 59 are connected to longitudinal ends of link members 61 via pins 62, respectively. Also, the other longitudinal ends of the link members 61 are connected to the piston rod 65 of a double acting pneumatic cylinder 64 via a pin 63. With this structure, when the piston rod 65 of the double acting pneumatic cylinder 64 is extended downwardly, the elastic rotation rolls 44 are displaced so as to separate from each other. When the piston rod 65 is retracted, the elastic rotation rolls 44 are displaced in a direction towards each other. In the condition wherein the elastic rotation rolls 44 have been displaced towards each other, the elastic rotation rolls 44 elastically sandwich the metal strip 42 inserted therebetween, and the elastic rotation rolls 44 elastically contact the elastic pads 45 so as to shut off the interior of the furnace body 48 from the outside air, thereby preventing the furnace gas 50 from leaking excessively and also preventing the outside air from entering the furnace.

Figure 3:
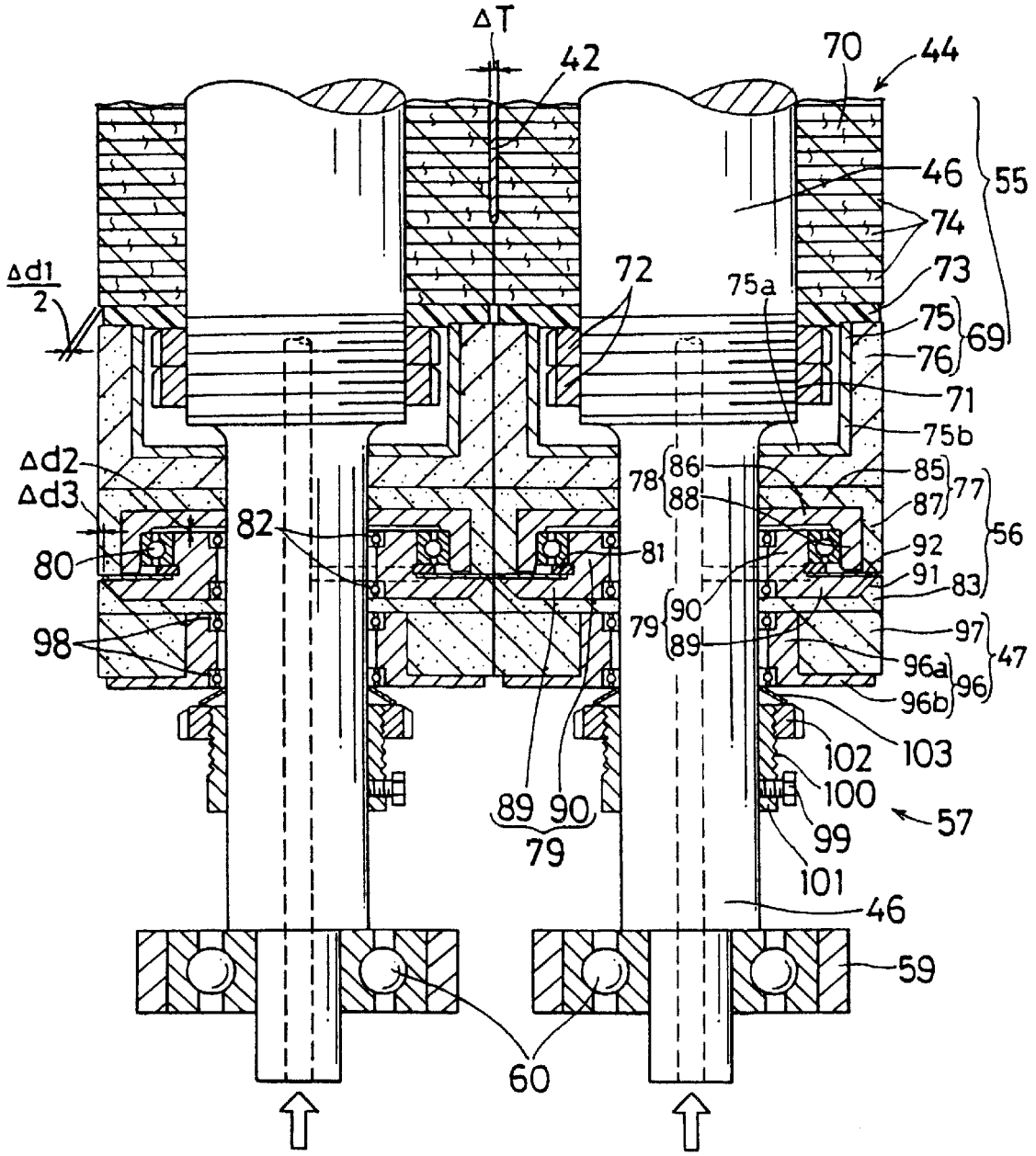
FIG. 3 is an enlarged sectional view taken on line A—A of FIG. 2.

FIG. 3 is an enlarged sectional view taken on line A—A of FIG. 2. The elastic rotation roll 44 has the roll shaft 46 and an elastic covering layer 70 formed on the right cylindrical outer peripheral surface of the roll shaft 46. At both ends of the elastic covering layer 70, a flange 73 is secured by an outer thread 71 and a nut 72. A plurality of discs 74 made of a nonwoven fabric are stacked or a long nonwoven fabric band is spirally wound and overlaid on the outer peripheral portion of the roll shaft 46 between the flange 73 and the other flange disposed on the other side of the roll shaft 46 so as to form the elastic covering layer 70 on the outer peripheral surface of the roll shaft 46. To prevent the elastic covering layer 70 from loosening, the flange 73 is firmly pushed and secured by the outer thread 71 and the nut 72. Outward from the flange 73 in the axial direction thereof, a metallic cover body 75 having the shape of a cylinder with a bottom is disposed so as to cover the outer thread 71 and the nut 72. On the outer peripheral surface of the cover body 75, an outer layer 76 made of an elastic material is formed such that the outer diameter of the outer layer 76 is the same as that of the elastic covering layer 70 of the elastic rotation roll. The axially outward end plate 75*a* of the cover body 75 is fitted on the roll shaft 46, and the axially inward end face of the cylindrical portion 75*b* of the cover body 75 comes into contact with the flange 73.

In this way, by combining the elastic covering layer 70 with the cover 69 constructed by forming the outer layer 76 on the cover body 75, it is possible to form the elastic rotation roll 44 as if the elastic rotation roll 44 has an integrated structure, the elastic rotation roll 44 having the same diameter as that of the central portion thereof, over the range between the outside ends of the covers 69 in the axial direction of the elastic rotation roll 44. In this case, the outer diameter of the flange 73 for pushing the nonwoven fabric discs 74 is smaller than the outer diameter of the elastic covering layer 76 by the maximum thickness $\Delta T$ of the metal strip 42 or by a value $\Delta d1$ slightly larger than the thickness $\Delta T$. With this structure, when the elastic rotation rolls 44 being opposed and contacting each other sandwich the metal strip 42, the flanges 73 of each elastic rotation roll 44 are prevented from contacting each other, thereby allowing the pushing force of each elastic rotation roll 44 to be applied to the metal strip 42, and ensuring sealing performance.

The nonwoven fabric disc 74 is made of aromatic polyamide fibers, carbon fibers or PTFE fibers, and the covering material of the outer layer 76 of the cover 75 is made of fluororubber, silicone rubber or chloroprene rubber, so that the elastic rotation roll 44 having high heat resistance and fire resistance can be obtained. In addition, to enhance chemical resistance of the elastic rotation roll 44, the nonwoven fabric disc 74 is made of PTFE fibers, PPS (polyphenylene sulfide) fibers, novoloid fibers, aromatic polyamide fibers or carbon fibers, and the covering material of the outer layer 76 of the cover 69 is made of butyl rubber, EPDM, chloroprene rubber or chlorosulfonated polyethylene rubber. Furthermore, by increasing the mixture ratio of carbon fibers into the nonwoven fabric of the nonwoven fabric disc 74, static electricity prevention performance of the elastic rotation roll can be obtained to some extent, and the heat resistance, fire resistance and chemical resistance can also be ensured. To particularly enhance the static electricity prevention performance, a nonwoven fabric including fibers mixed with carbon, a nonwoven fabric using fibers in which polypyrrole, electron-conjugated conductive polymer, is formed chemically, or a nonwoven fabric using fibers made by treating acrylic fibers with a compound including sulfur and a divalent copper compound is used as the nonwoven fabric. A conductive nonwoven fabric having a specific electric resistance in the range of 1 to $10^7$ $\Omega\cdot$cm can be used for any of the above-mentioned types of nonwoven fabric. More specifically, SA-7 (trade name) [made by Toray], ANTRON III (trade name) [made by Du Pont], VLS6209F (trade name) [made by Japan Vilene], Sanderlon SS-N (trade name) [made by Nihon Sanmou Senshoku Kabushiki Kaisha], etc. can be used.

By mounting the covers 69 at both ends of the roll body 55, the outer thread 71 and the nut 72 can be protected against corrosive gas or vapor. Furthermore, since the outer thread 71 and the nut 72 are surrounded by the cover 69, the danger caused by rotation of protruding parts can be prevented.

As another embodiment of the invention, instead of the structure comprising a plurality of the nonwoven fabric discs 74 or a wound nonwoven fabric band as the elastic covering layer 70, an elastic body may be used which is made of one kind of material selected from among silicone rubber, fluororubber, styrene-butadiene rubber (SBR), hydrin rubber, nitrile-butadien rubber (NBR), chloroprene rubber (CR), ethylene-propylene rubber (EPDM), butyl rubber, urethane rubber, isoprene rubber, butadiene rubber, chlorosulfonated polyethylene (CSM), chlorinated polyethylene (CM), acrylic rubber (ACM) and polysulfide rubber, the elastic body having a hardness in the range of 40° to 90° as a value specified in JIS K 6301 A and having its inherent specific electric resistance or being provided with conductivity so as to have a specific electric resistance in the range of 1 to $10^7$ Ω·cm. When the elastic body provided with conductivity has a specific electric resistance of more than $10^7$ Ω·cm, the elastic body is substantially the same as the insulator. When the elastic body has a specific electric resistance of less than 1 Ω·cm, sparks may occur from a charged body such as a human body having approached the facility to make inspection. Therefore, the specific electric resistance should preferably be selected in the range of 1 to $10^7$ Ω·cm.

When the hardness of the elastic body is less than 40°, the elastic body is too soft and deforms excessively in the case of sandwiching the metal strip 42, and the durability of the elastic body is lost at high speed rotation. In addition, the elastic body is apt to be damaged by the sharp angles at both ends of the metal strip 42 in the width direction thereof. The elastic body having such a low hardness is thus not sufficient. When the hardness of the elastic body is higher than 90°, the elasticity of the elastic body is insufficient, and even in the case of sandwiching the metal strip 42, the covering layer 70 does not deform so as to eliminate clearances caused by the thickness of the metal strip 42 at both ends of the metal strip 42 in the width direction thereof, and thereby the sealing performance is insufficient. The elastic body having such a high hardness is thus not sufficient. Therefore, the hardness should preferably be selected in the range of 40° to 90°.

Figure 4:
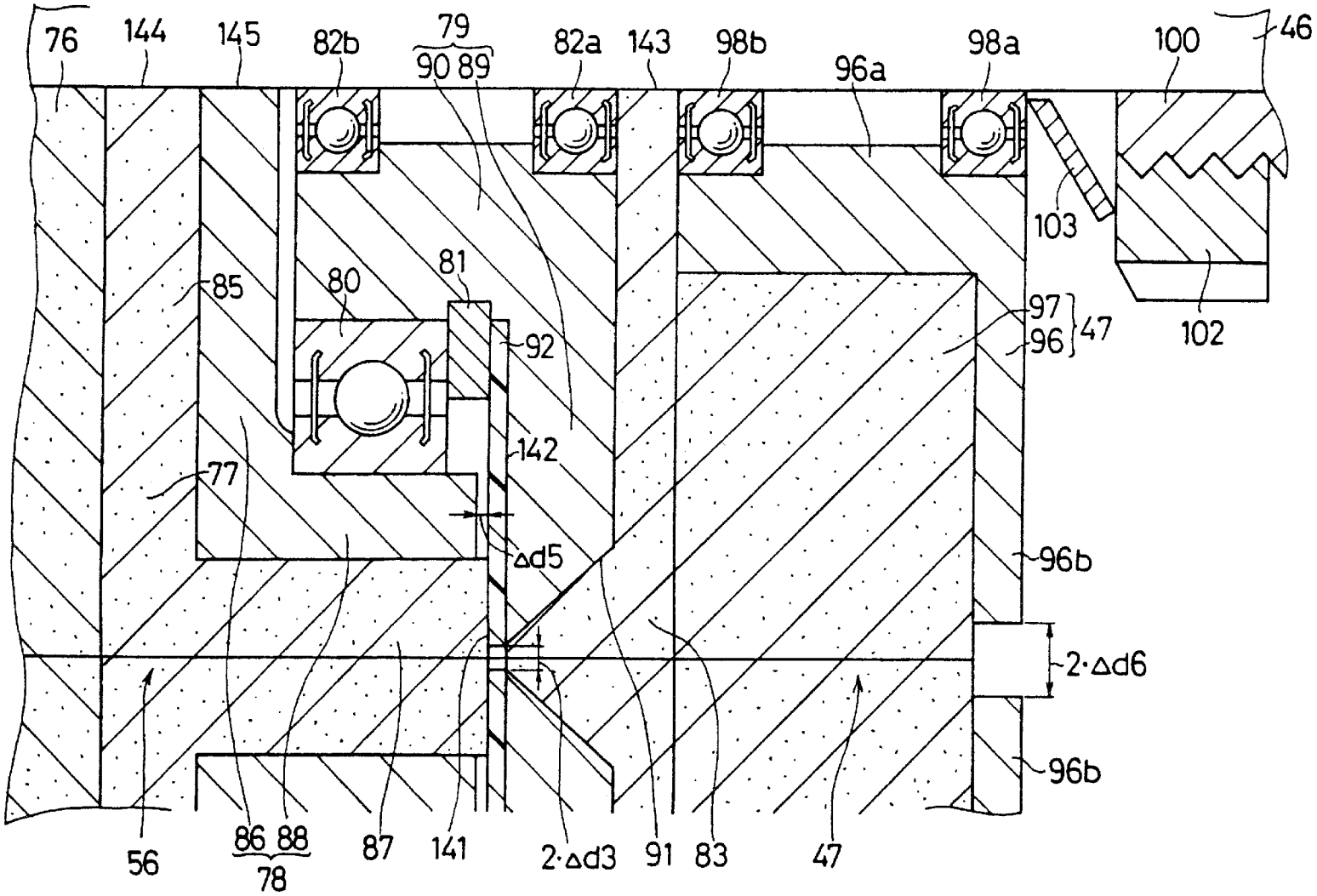
FIG. 4 is a partial enlarged sectional view showing an area around a seal disc and a rotation disc.

FIG. 4 is a partial enlarged sectional view showing an area around the seal disc 47 and the rotation disc 56. An outer covering member 77, a first supporting member 78, a second supporting member 79, an outer bearing 80, a retaining ring 81, inner bearings 82 and an end face sealing member 83 are disposed between the seal disc 47 and the cover 69 as the members constituting the rotation disc 56. The inner bearings are designated by reference numerals 82*a*, 82*b* individually and designated by a reference numeral 82 generally.

The outer covering member 77 and the end face sealing member 83 are provided with enhanced mechanical characteristics by mixing carbon black or the like in the elastic material similar to that of the outer layer 76 or the elastic covering layer 70, and also provided with a specific electric resistance in the range of 1 to $10^7$ Ω·cm to prevent separation, deformation and friction caused by rotational contact between the rotation discs 56 and to prevent electrification caused by sliding contact with the elastic pad 45. The first flange portion 85 of the outer covering member 77 contacts the end face of the cover 69, and the second flange portion 86 of the first supporting member 78 contacts the first flange portion 85 of the outer covering member 77. At the outer peripheral portion of the first flange portion 85 of the outer covering member 77, a first cylindrical portion 87 extends axially outward. A second cylindrical portion 88 of the first supporting member 78 extends axially outward from the outer peripheral portion of the second flange portion 86. The outer peripheral surface of the second cylindrical portion 88 contacts the inner peripheral surface of the first cylindrical portion 87. The axial length of the second cylindrical portion 88 is slightly shorter than the value obtained by subtracting the thickness of the first flange portion 85 from the axial length of the first cylindrical portion 87 so as to prevent metallic contact between the second cylindrical portion 88 and the third flange portion 89 of the second supporting member 79.

A third cylindrical portion 90 of the second supporting member 79 is interposed between the second cylindrical portion 88 and the roll shaft 46. A clearance Δd2 is offered between the axially inward end face of the third cylindrical portion 90 and the axially outward surface of the second flange portion 86. The axially outer end of the third cylindrical portion 90 is integrated with the third flange portion 89 extending outward in the radial direction of the third cylindrical portion 90. An inclined face 91 is formed on the outer peripheral portion of the third flange portion 89 so that the diameter of the third flange portion 89 reduces axially outward. The in an axially outward direction side of the third flange portion 89 structured as described above is supported by the axially inward end face of the seal disc 47 via the end face sealing member 83.

Although the metal strip 42 appears to travel straight, it actually slightly snakes repeatedly. Therefore, each of the elastic rotation rolls 44 sandwiching the metal strip 42 always receives a thrust force in the axial direction of the roll due to a repulsion force caused by the snaking of the metal strip 42. The thrust force is transmitted to the third cylindrical portion 90 of the second supporting member 79 by the second flange portion 86 of the first supporting member 78 and the outer bearing 80 via the retaining ring 81 of the third cylindrical portion 90. In other words, the positional relationship between the first supporting member 78 and the second supporting member 79 is determined depending on the outer bearing 80. No matter how the thrust force is changed, only a constant force, such as an elastic repulsion force exerted at the end of the outer covering member 77, is applied to the portion where the end face of the first cylindrical portion 87 of the outer covering member 77 contacts the axially inward outer peripheral portion of the third flange portion 89 while rotating and sliding. The rotating and sliding contact portion is not affected by the thrust force generated by the snaking of the metal strip 42 or the thermal expansion of the elastic rotation roll 44.

Accordingly, stable sealing performance can be attained at the rotating and sliding contact portion for an extended period of time. To further ensure the effect of sealing, a disc made of polytetrafluoroethylene (trade name: Teflon, abbreviation: PTFE) or a nonwoven fabric of aromatic polyamide fibers or PTFE fibers, or a sliding ring 92 made of ultra-high-molecular-weight polyethylene (trade name: Newlite the like) or PTFE with a packing material (trade name: Exelite or the like) should preferably be interposed between the third flange portion 89 of the second supporting member 79, and the retaining ring 81 and the first and second cylindrical portions 87, 88, as a superior sliding member having a low coefficient of friction with metal. This sliding ring 92 can prevent the third flange portion 89 from directly contacting the first cylindrical portion 87, thereby offering rotating and sliding contact having better sliding performance.

The outer diameter of the sliding ring 92 is made smaller by a slight dimension Δd3 inward in the radial direction thereof than the outer peripheral surfaces of the elastic covering layer 70, the cover 69, the outer covering member 77 and the end face sealing member 83. With this structure, even when the elastic rotation rolls 44 contact each other elastically and the outer peripheral surfaces of the rolls cause slight elastic deformation, there is no danger of allowing the sliding ring 92 provided on one of the rolls 44 to contact and interfere with the sliding ring 92 provided on the other roll 44, thereby being capable of attaining smooth rotation. The outer diameter of the sliding ring 92 is smaller by Δd3 than the outer diameters of the elastic covering layer 70, the cover 69, the outer covering member 77, the end face sealing member 83 and the seal disc 47. The Δd3 is selected to have a value equal to or slightly larger than the half of the thickness ΔT of the metal strip 42 to be sandwiched by the elastic rotation rolls 44. In other words, the outer diameter of the sliding ring 92 is made to have the same dimension as the outer diameter of the third flange portion 89 of the second supporting member 79 of the rotation disc 56.

With this structure, wear due to direct contact between the axially outward end face of the first cylindrical portion 87 of the outer covering member 77 and the third flange portion 89 of the second supporting member 79 does not occur, thereby preventing the sealing performance from lowering. Furthermore, since relatively large friction due to sliding contact between rubber and metal does not occur, the rotation resistance of the rotation disc 56 can be reduced.

Clearance Δd5 is provided between the axially outward end face (rightward in FIG. 4) of the second cylindrical portion 88 and the sliding ring 92 so that they do not contact each other. With this structure, the end face 141 of the first cylindrical portion 87 securely contacts the end face of the sliding ring 92. The sliding ring 92 contacts the end face 142 of the third flange portion 89. Since the coefficient of friction between the sliding ring 92 and the third flange portion 89 is smaller than that between the sliding ring 92 and the first cylindrical portion 87, the sliding ring 92 can easily slide with the third flange portion 89.

The seal disc 47 includes a metallic reel 96 having a flange 96*b* on one side or flanges (not shown) on both sides of a cylindrical portion 96*a* in the axial direction thereof, a seal disc elastic body 97 having a ring shape or a hollow cylindrical shape and mounted on the reel 96, and bearings 98 interposed between the outer peripheral portion of the roll shaft 46 and the inner peripheral portion of the cylindrical portion 96*a* of the reel 96. The bearings are designated by reference numerals 98*a*, 98*b* individually and designated by a reference numeral 98 generally. The seal disk 47 can thus be rotatably mounted at both ends of the roll shaft 46 in the axial direction thereof.

Since the roll shaft 46 is supported by the bearings 98, the elastic rotation roll 44 is rotated when the metal strip 42 is passed through. By the rotation, the axially outward end face of the cover 69 and the axially inward end face of the outer covering member 77 of the rotation disc 56 contact each other closely and rotate integrally. However, since the seal disc 47 is pushed axially inward by the pushing device 57, the pushing force is transmitted axially inward to the end face sealing member 83 of the rotation disc 56, and a constant pushing force optimally suited for sealing can be maintained at the end face sealing member 83 and the seal disc 47. The outer diameter of the flange 96*b* is made smaller than the outer peripheral surfaces of the elastic rotation roll 44 and the seal disc 47, and a clearance 219 Δd6 (Δd3≦Δd6) is provided between the flanges 96*b*.

Bearings 98*a*, 98*b*; 82*a*, 82*b* and the bearing 80 are all deep-groove ball bearings and can receive thrust and radial forces. The inner peripheral surfaces of the inner rings of the bearings 98*a*, 98*b*; 82*a*, 82*b* can be axially displaced relatively to the outer peripheral surface of the roll shaft 46. Therefore, the spring force of a belleville spring 103 is transmitted to the reel 96 via the bearings 98*a*, 98*b* and then provided to the seal disc elastic body 97 and the end face sealing member 83. The inner peripheral surface 143 of the end face sealing member 83 can be axially-displaced and rotated relative to the outer peripheral surface of the roll shaft 46. Accordingly, the spring force of the belleville spring 103 is further transmitted from the end face sealing member 83 to the first supporting member 78 via the second supporting member 79, the retaining ring 81 and the bearing 80, and then further transmitted to the outer covering member 77. The inner peripheral surfaces 144, 145 of the first and second flange portions 85, 86 can also be axially-displaced and rotated relative to the outer peripheral surface of the roll shaft 46. The inner peripheral surfaces of the outer layer 76 and the end plate 75*a* shown in FIG. 3 can also be axially-displaced and rotated relative to the outer peripheral surface of the roll shaft 46. In this way, the seal disc 47 and the rotation disc 56 can be positioned properly with respect to the elastic rotation roll 44 by the spring force of the belleville spring 103. Even when the components disposed along the axial direction of the roll shaft 46 from the cover body 75 and the outer layer 76 to the reel 96 are worn, the sealing function can be ensured by the spring force.

The pushing device 57 is mounted on the roll shaft 46, secured in place by a bolt 99. The pushing device 57 includes a threaded cylindrical body 101 having a right cylindrical shape and provided with an outer threaded 100 on the outer peripheral surface thereof, a nut 102 engaged with the outer threaded 100 of the thread cylindrical body 101, and a spring, such as the belleville spring 103, interposed between the nut 102 and the inner race of the bearing 98 of the seal disc 47. Instead of the belleville spring 103, a compression coil spring may be used.

Even when a clearance occurs at each contact position because of the slight snaking of the metal strip 42, the thermal expansion of the elastic rotation roll 44, slight wear due to friction contact between the outer covering member of the rotation disc 56 and the cover 69, slight wear due to friction contact between the end face sealing member 83 and the seal disc 47, and shrinkage due to the degeneration or deterioration of elastic bodies, the seal disc 47 is elastically pushed axially inward at all times by the pushing device 57 so as to compensate for the clearance.

The deep-groove ball bearings 98*a*, 98*b*; 82*a*, 82*b*; 80 used for the above-mentioned embodiment, wherein lubricant, such as grease, and balls lubricated by the lubricant are sealed by sealing plates, are advantageous in that contamination due to use of lubricant can be prevented. As another embodiment, sliding bearings, for example, may be used for the bearings 98*a*, 98*b*; 82*a*, 82*b*; 80. When the sliding portions of the sliding bearings are made of synthetic resin, no lubricant is required, and the bearings are superior in that they do not generate abrasion powder. As such synthetic resin, a hard-to-wear material having a small coefficient of dynamic friction at mutual contacting surfaces, for example, (a) fluororesin such as polytetrafluoroethylene resin, (b) resin mainly consisting of fluororesin, such as polytetrafluoroethylene resin, and including glass fiber, graphite, glass fiber and molybdenum disulfide, glass fiber and graphite, bronze, or carbon fiber as a filling material for enhancing wear resistance and rigidity (trade name: Exelite), (c) only fluororesin or fluororesin including a filling material, which is coated, sprayed or baked on all surfaces including the inner peripheral and outer peripheral surfaces and both side surfaces of each metal member, (d) only fluororesin or fluororesin including a filling material, which is formed in a sheet shape by coating, spraying or baking and attached to both side surfaces of each metal member, or (e) ultra-high-molecular-weight polyethylene (trade name: Newlite) can be used. Instead of the synthetic resin, metal may be used.

Figure 5:
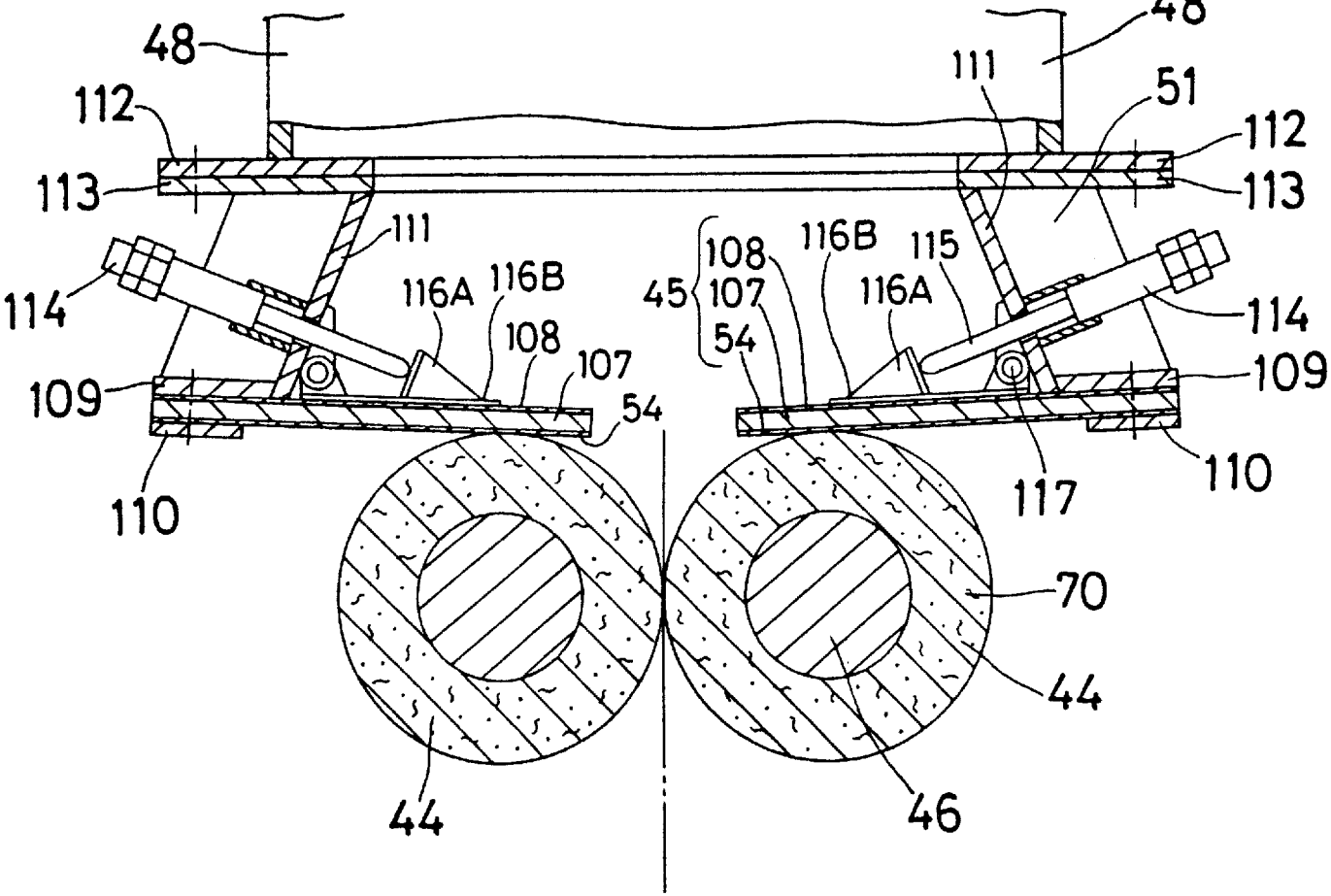
FIG. 5 is a sectional view showing a concrete structure for mounting elastic pads on frames.

FIG. 5 is a sectional view showing a concrete structure for installing the elastic pad 45 on the frame 51. The elastic pad 45 has an elastic body 107, a sealing fixture 108 and a surface layer portion 54 contacting the outer peripheral portion of the elastic rotation roll 44. The material of the surface layer portion 54 is selected so that profiling performance to the minute irregularities of the outer peripheral surface of the elastic rotation roll 44 may be excellent, and so as to have wear resistance without damaging the soft surface of the elastic rotation roll 44 and so as to prevent fluffing or falling out of fibers caused by rotational friction. As an example, aromatic polyamide fibers, acrylic fibers, polyester fibers, wool fibers, or a nonwoven fabric made by a combination of these fibers can be used. However, a material having an LOI value of 26 or more is used optimally to prevent melting and dropping and to ensure flame resistance and heat resistance for a short time when leaked atmospheric gas is ignited. As a specific example, aromatic polyamide fibers (in particular, para type) are suitable, since they have a high melting point of 400° C. to 500° C. A nonwoven fabric made of such fibers as described above is used for the elastic body 107. The hardness of the elastic body 107 is in the range of 10° to 50° as a value specified in JIS S 6050 in combination with the surface layer portion 54, and the elastic body 107 is reinforced by the sealing fixture 108. To prevent fires and explosions caused by spark discharge of static electricity, a nonwoven fabric having a specific electric resistance in the range of $10^{-3}$ to $10^{7}$ Ω·cm is used for the surface layer portion 54 of the elastic pad 45 to offer an appropriate conductivity. Accordingly, when the elastic rotation roll 44 is made of an insulator, this structure can prevent the elastic rotation roll 44 and the elastic pad 45 from being electrified and can also prevent spark discharge, thereby ensuring the safety of operation. Instead of the above-mentioned structure of the elastic pad 45, a minutely foamed, expanded-sponge-like elastic body made of an elastic material such as rubber having elasticity similar to that of the elastic body 107 may be used as the elastic member 107, and a nonwoven fabric having wear resistance, flame resistance, heat resistance and conductivity may be attached to the surface layer portion 54 contacting the elastic rotation roll 44. In any case, the elastic pad having a hardness, which corresponds to the elastic value of the elastic pad, in the range of 10° to 50° as a value specified in JIS S 6050 is used preferably.

The elastic pad 45 having this kind of structure is sandwiched by the lower flange 109 of a connecting member 111 and a metallic holding plate 110. A supporting plate 116B equipped with a bracket 116A is connected to the connecting member 111 via a hinge 117 so as to have any desired angular displacement. The upper flange 113 of the connecting member 111 is secured to the flange 112 of the furnace body 48 by a bolt or the like. A pushing force adjustment mechanism 114, such as a double-acting cylinder or a compression spring, is mounted on the connecting member 111. The tip of the piston rod 115 of the pushing force adjustment mechanism 114 pushes the inclined surface of the bracket 116A mounted on the supporting plate 116B. As a result, the sealing fixture 108 is pushed and the elastic pad 45 undergoes angular displacement around the axis of the hinge 117 so as to contact the outer peripheral surface of each elastic rotation roll with an appropriate pushing force. When the surface layer portion 54 of the elastic pad 45 is made of a conductive nonwoven fabric, the static electricity generated on the elastic rotation roll 44 is grounded via the elastic pad 45. In addition, since the fibers of the nonwoven fabric are thin, even when the specific electric resistance of the nonwoven fabric in the range of $10^{-3}$ to $10^{7}$ Ω·cm is lower than the specific electric resistance of the elastic rotation roll 44 in the range of 1 to $10^{7}$ Ω·cm, spark discharge does not occur because of corona discharge from the tips of the fibers, thereby preventing the elastic rotation roll 44 from being electrified. Since electrification of static electricity on each elastic rotation roll 44 can be prevented in this kind of embodiment, the elastic rotation roll 44 is not always required to be made conductive.

By mounting the elastic pad 45 on the frame 51 as described above, the furnace gas 5*a* can be sealed and spark discharge due to static electricity on the elastic rotation roll 44 can be prevented securely.

Since side walls are provided on both sides of each elastic rotation roll in the prior art described before, by considering the shrinkage allowance of the elastic disc (washer 32) so that the elastic disc disposed between the side wall and each elastic rotation roll delivers an appropriate repulsion force, the elastic disc is required to be made so as to have a thickness slightly larger than the dimension obtained by subtracting the thicknesses of the washers 33 and 34 from the clearance between the end of the roll and the side wall. Furthermore, the roll is required to be positioned and installed accurately so that the clearance between one end of the roll and one side wall is equal to that between the other end of the roll and the other side wall. In the case of the present embodiment, it is not necessary to provide the side wall on both sides of each elastic rotation roll. Therefore, in this structure, after the elastic rotation roll is positioned roughly and installed, the threaded cylindrical body 101 is secured to the roll shaft 46 with the bolt 99, and the nut 102 provided on the threaded cylindrical body 101 is tightened to push the seal disc 47, so that the seal disc 47 can be properly positioned so as to seal the end face of the roll. After this, an appropriate pushing force can be provided by the repulsion force of the bellleville spring 103 mounted on the roll shaft. Accordingly, each elastic rotation roll 44 can be installed easily and quickly at the optimal position without requiring special skills.

Furthermore, as shown in FIG. 3, the axially inward end face of the first flange portion 85 of the outer covering body 77 is always pushed against the axially outward end face of the outer layer 76 of the cover 69 by a constant force exerted by the belleville spring 103. Therefore, even when the axial length of the elastic rotation roll 44 is changed because of thermal expansion, even when the hardness or elasticity of the outer covering member 77 and the outer layer 76 of the cover 69 are changed because of a rise in temperature, or even when the axial length between the elastic rotation roll 44 and the pushing device 57 is changed because of partial wear, the optimal pushing force can be maintained automatically, thereby being capable of attaining a constant sealing effect stably for an extended period of time.

In addition, as shown in FIG. 1, the axial length of the seal disc elastic body 97 of the seal disc 47 is equal to or longer than the axial width (thickness) of the sealing side wall 49, and at least the axially inward portion of the seal disc elastic body 97 is set at the same position as the axially inward surface 49*a* of the sealing side wall 49 or projected by length Δd4. Therefore, even when the seal disc 47 is axially dislocated slightly, the sealing performance can be maintained properly as long as the outer peripheral surface of the seal disc elastic body 97 contacts the arc-shaped contact surface 52 of the sealing side wall 49, the arc-shaped contact surface 52 facing the outer peripheral surface. Accordingly, the roll shaft 46 is not required to be displaced in the axial direction thereof after the elastic rotation roll 44 is installed. Furthermore, without removing the roll shaft 46 installed and secured to the bearings 60, the clearance between the cover 69 and the rotation disc 56 and the clearance between the rotation disc 56 and the seal disc 47 can be adjusted independently at each end of the elastic rotation roll 44 in the axial direction thereof. Moreover, since these clearances and the pushing force can be adjusted via the nut 102 and the spring 103, fine adjustment is possible and adjustment can be made easily and quickly.

When the hardness of the seal disc elastic body 97 is less than 40°, its rigidity is insufficient. Consequently, when the seal disc 47 is axially displaced while pushed against the sealing side wall 49, the elastic body 97 deforms significantly and its durability becomes insufficient. The seal disc elastic body 97 having such a low hardness is thus unsuitable. When the hardness is more than 90°, a large force is required to cause elastic deformation at the portion of the seal disc 47 facing and contacting the sealing side wall 49. However, since the pushing force of the elastic rotation roll 44 for sandwiching the metal strip 42 is insufficient, the seal disc elastic body 97 does not deform sufficiently and the clearance caused by the thickness of the tip portion of the sealing side wall 49 cannot be eliminated, thereby causing insufficient sealing. The seal disc elastic body 97 having such a high hardness is thus unsuitable. Accordingly, the hardness should preferably be in the range of 40° to 90° just as in the case of the covering layer 70 of the elastic rotation roll and the outer covering member 77 of the rotation disc.

What is more, after a process line is operated to check the sealing conditions and the rotation resistance conditions of the elastic rotation rolls 44, the sealing conditions and the rotation resistance conditions can be adjusted as desired while the elastic rotation rolls 44 remain installed. Therefore, the process line is not required to be stopped for an extended period of time to perform adjustment, thereby preventing productivity from lowering. In particular, since no side wall is provided outward in the axial direction of the elastic rotation roll, unlike the prior art, any large space is not required for the installation of the sealing apparatus 41 and the replacement of the elastic rotation roll 44. Thus the structure can be simplified and spaces can be offered to allow other apparatuses to be installed easily near the compartment inlet/outlet. Therefore, the degree of freedom in design can be made higher, the sealing apparatus 41 can be made more compact, and the production cost can be reduced. Furthermore, since the elastic rotation roll 44 can be installed from directly underneath, beside or axially outside the frame 51, the installation of the elastic rotation roll 44 has a high degree of freedom and can be done easily.

Figure 6:
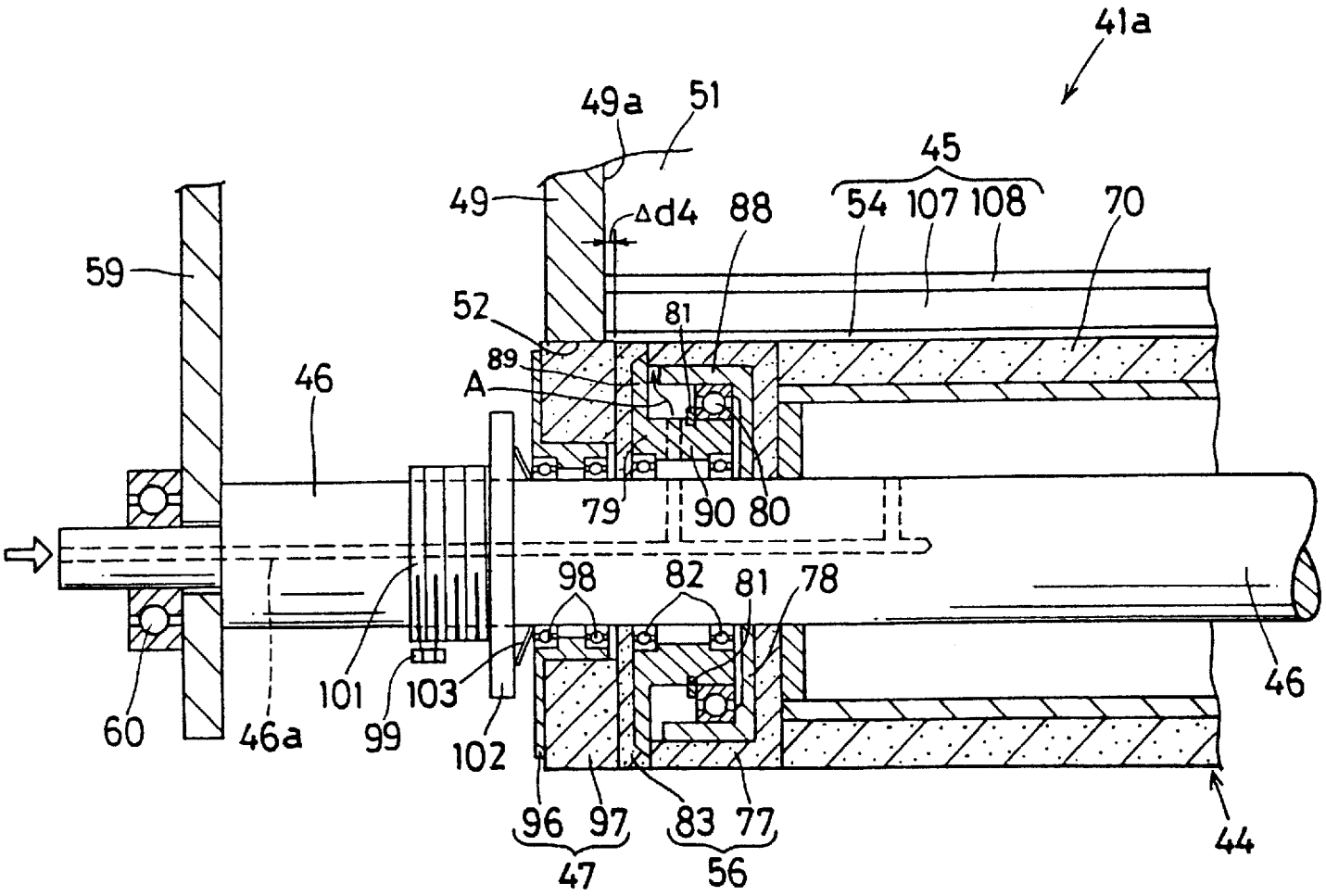
FIG. 6 is a partial enlarged sectional view showing a sealing apparatus in accordance with another embodiment of the invention.

FIG. 6 is a partial enlarged sectional view showing a sealing apparatus 41*a* in accordance with another embodiment of the invention. The same reference numerals designate the parts corresponding to the above-mentioned embodiment. The sealing apparatus 41*a* of this embodiment differs from the embodiment shown in FIGS. 1–3 in that the sliding ring 92 is not shown in the rotation disc 56, the elastic covering layer 70 is an integrated member made of an elastic material such as rubber, and the outer thread 71, the nut 72, the flange 73 and the cover 69 shown in FIGS. 1–3 are not provided. A pipe line 46*a* is provided from the end of the roll shaft 46 to at least the rotation disc 56, and a gas closely analogous to the furnace gas, an inert gas or nitrogen gas is slightly supplied from the end. The gas is allowed to slightly leak from the clearance at the rotating and sliding contact portion between the axial end of the outer covering member 77 and the axially inward end of the third flange 89 of the second supporting member 79 to the outer peripheral portion as indicated by arrow A (the sliding ring 92 is not shown). With this structure, the pressure in the rotation disc 56 can be made higher than the outside pressure, and the outside air can be prevented from entering. In addition, the gas is effective in cooling the rotating and sliding portion, and the flow of the gas prevents solid parts from contacting one another, thereby being capable of reducing friction at the rotating and sliding portion. The rotation disc 56 can be used without causing any problem even when the disc is installed in the orientation opposite to that shown in FIG. 6 in the right-and-left direction. Furthermore, at this time, even when the third cylindrical portion 90 is directly mounted on the roll shaft 46 without using the inner bearing 82, the rotation disc 56 can be used, thereby being capable of reducing the number of parts.

Figure 7:
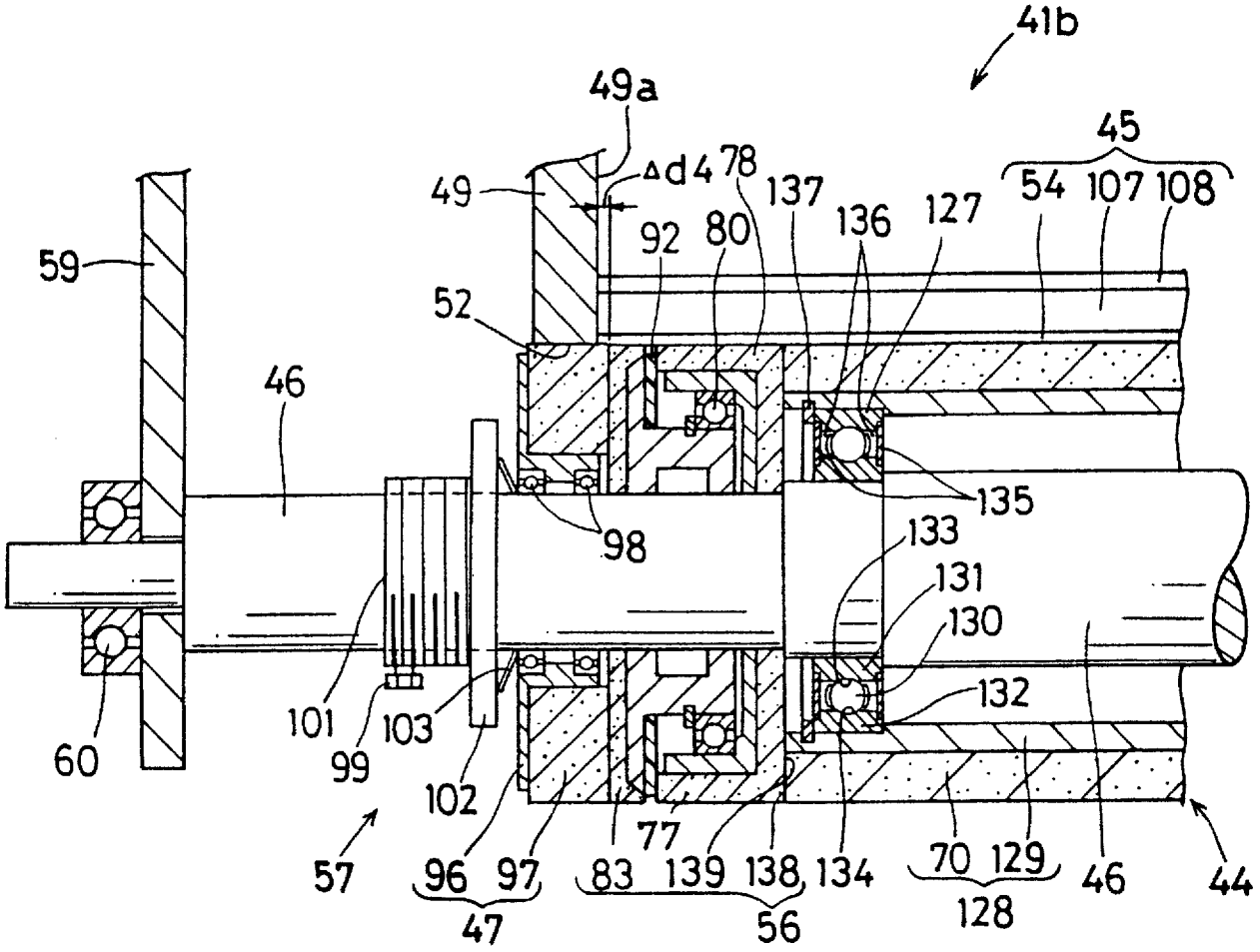
FIG. 7 is a partial enlarged sectional view showing a sealing apparatus in accordance with still another embodiment of the invention.

FIG. 7 is a partial enlarged sectional view showing a sealing apparatus 41*b* in accordance with yet another embodiment of the invention. The same reference numerals designate the parts corresponding to the above-mentioned embodiments. In this embodiment, attention should be given to the facts that a deep-groove ball bearing 127 is disposed adjacent to the rotation disc 56 on the roll shaft 46 in the axially inward direction of the rotation disc 56, and that the roll shaft 46 and a roll body portion 128 are rotatable relative to each other. The roll body portion 128 comprises a roll sleeve 129 having a right cylindrical shape and the elastic covering layer 70 overlaid on the outer peripheral surface of the roll sleeve 129. The deep-groove ball bearing 127 is a single row deep-groove ball bearing specified in JIS B 1521. A plurality of rolling bodies 130 made of steel balls roll, while being sandwiched between the inner race track 133 and the outer race track 134 formed on the inner race 131 and the outer race 132 of the bearing respectively at equal intervals in the peripheral direction of the bearing. On both sides of each rolling body 130 in the axial direction of the bearing, ring-shaped sealing members 135 are provided, and grease 136 is sealed between the sealing members 135 as a lubricant.

This kind of sealed type single row deep-groove ball bearing 127 has low friction torque and is superior in high speed, grease sealing performance and dust prevention. In addition, the deep-groove ball bearing 127 can simultaneously receive radial and thrust forces between the inner race 131 and the outer race 132. As an example of the deep-groove ball bearing 127, a sealed type (ZZ type) in which steel sheet seals are used, a non-contact rubber sealed type (VV type) in which rubber seals are used, or contact rubber sealed type (DDU type) made by Nippon Seiko can be used. A retaining ring 137 fitted in the inner peripheral portion of the roll sleeve 129 prevents the deep-groove ball bearing 127 from being removed.

According to this structure, since the axially inward end face 139 of the outer covering member 77 of the rotation disc 56 closely contacts the axially outward end face 138 of the elastic covering layer 70 with the elastic force of the spring 103, the end face of the roll body portion 128 can be sealed. Furthermore, since the grease 136 is sealed in the deep-groove ball bearing 127, the rotation resistance of the bearing is extremely low. In the case of this embodiment, even when the roll body portion 128 is rotated as the metal strip 42 is passed through, the roll shaft 46 is not rotated. Therefore, the bearing 60 is not required to be a bearing having rolling bodies. However, a bearing having rolling bodies can be used as shown in FIG. 7 without causing problems. Moreover, although the inner bearings (not shown) of the second supporting member of the rotation disc 56 and the bearings 98 of the seal disc 47 are not necessary, these bearings can be used without causing problems.

Figure 8:
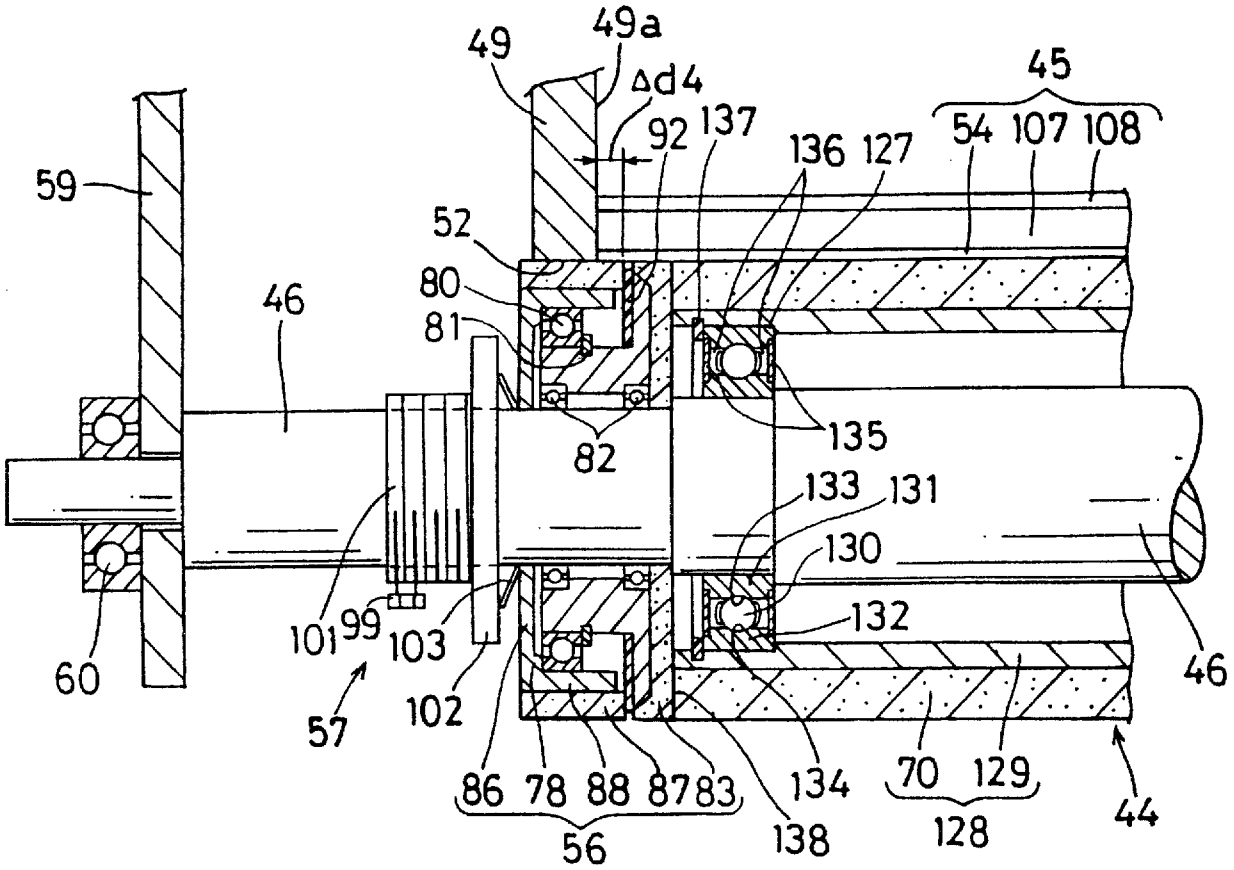
FIG. 8 is a partial enlarged sectional view showing a sealing apparatus in accordance with yet still another embodiment of the invention.

FIG. 8 is a partial enlarged sectional view showing a sealing apparatus 41*c* in accordance with still yet another embodiment of the invention. The same reference numerals designate the parts corresponding to the above-mentioned embodiments. Instead of the seal disc 47, so to speak, the rotation disc 56 is used in the sealing apparatus 41*c* of this embodiment. The first cylindrical portion 87 of the outer covering member 77 is fitted on the outer peripheral surface of the second cylindrical portion 88 of the first supporting member 78 so that the outer peripheral surface of the first cylindrical portion 87 directly contacts the arc-shaped contact surface 52 of the side wall 49, thereby attaining sealing. In addition, the second flange portion 86 of the first supporting member 78 is formed axially outward (leftward in FIG. 8). As compared with the above-mentioned embodiments, the rotation disc 56 is reversed in the axial direction thereof and mounted on the roll shaft 46. In other words, the first supporting member 78 and the second supporting member 79 are interchanged with each other. The rotation of the roll shaft 46 is isolated from the rotation of the roll sleeve 129 by the deep-groove ball bearing 127 just as in the case of the embodiment shown in FIG. 7.

With this structure, when the axial length between both end faces 138 of the elastic covering layer 70 of the roll body portion 128 is made constant, the components to be disposed axially outward from the end face 138, such as the first supporting member 78 of the rotation disc 56, the pushing device 57 and the sealing side wall 49, can be disposed closer in the axially inward direction, and the seal disc 47 can be omitted, thereby being capable of making the structure smaller.

Figure 9:
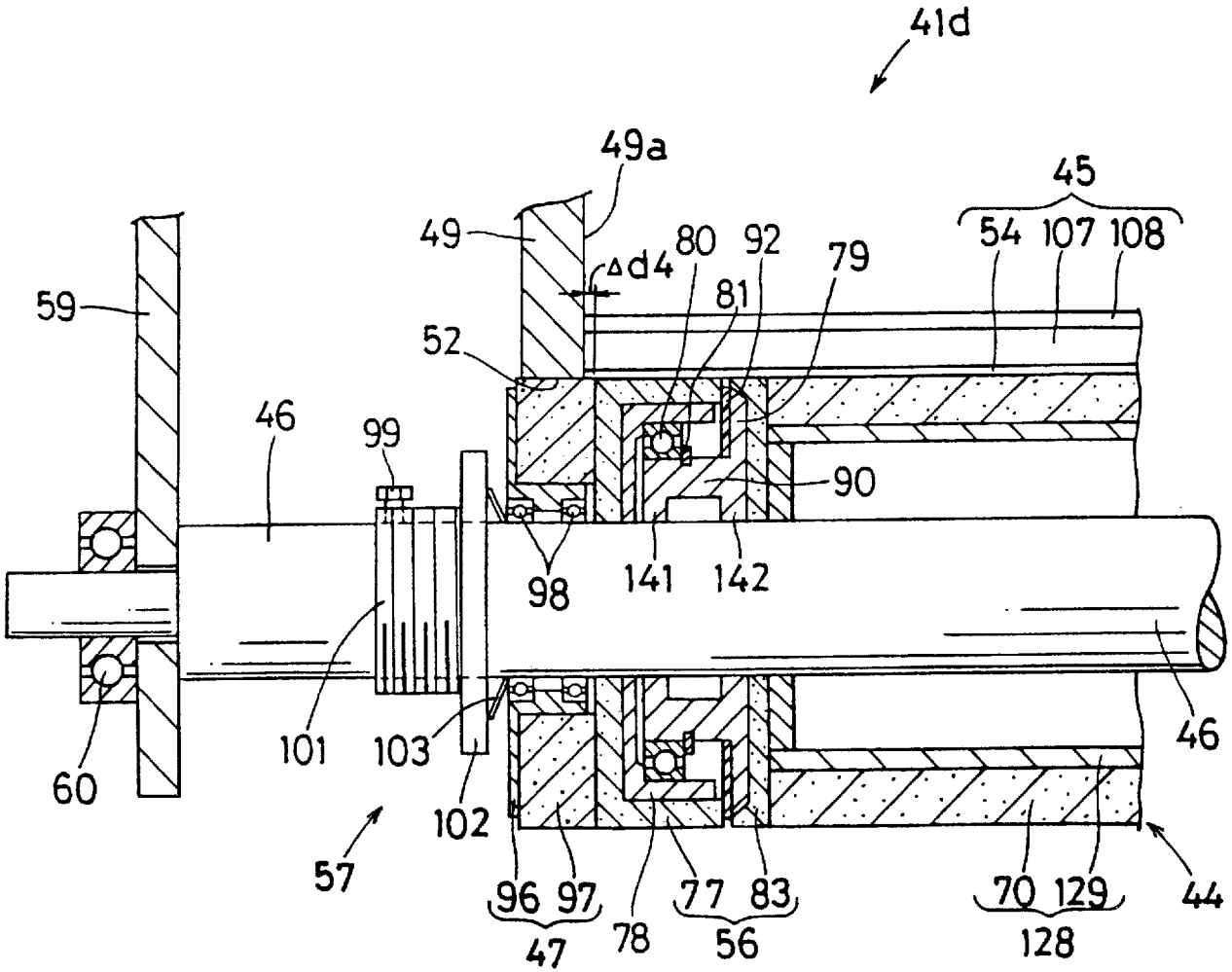
FIG. 9 is a partial enlarged sectional view showing a sealing apparatus in accordance with a further embodiment of the invention.

FIG. 9 is a partial enlarged sectional view showing a sealing apparatus 41*d* in accordance with a further embodiment of the invention. This embodiment is similar to the embodiment shown in FIG. 6 and the same reference numerals designate the parts corresponding to the above-mentioned embodiments. Unlike the embodiment shown in FIG. 6, in which the inner bearings 82 are disposed between the second supporting member 79 and the roll shaft 46, instead of the inner bearings 82, a pair of inside projecting portions 141, 142 connected to both ends of the third cylindrical portion 90 of the second supporting member 79 in the axial direction of the third cylindrical portion 90 and extending inward in the radial direction thereof are integrally formed so as to be directly fitted on the roll shaft 46 in the sealing apparatus 41*d* of this embodiment.

With this structure, the inner bearings 82 can be omitted. Accordingly, the parts count for the apparatus can be reduced, the assembly can be simplified, the production cost can be reduced and the maintainability can be improved. In this embodiment, the rotation disc 56 has a structure similar to that obtained by reversing the rotation disc shown in FIG. 6 in the axial direction thereof. The seal disc 47 is disposed axially outward from the rotation disc 56 just as in the cases of the embodiments shown in FIGS. 1, 3, 4, 6 and 7.

The same effect as the embodiment shown in FIG. 6 can be also attained by using this structure.

Figure 10:
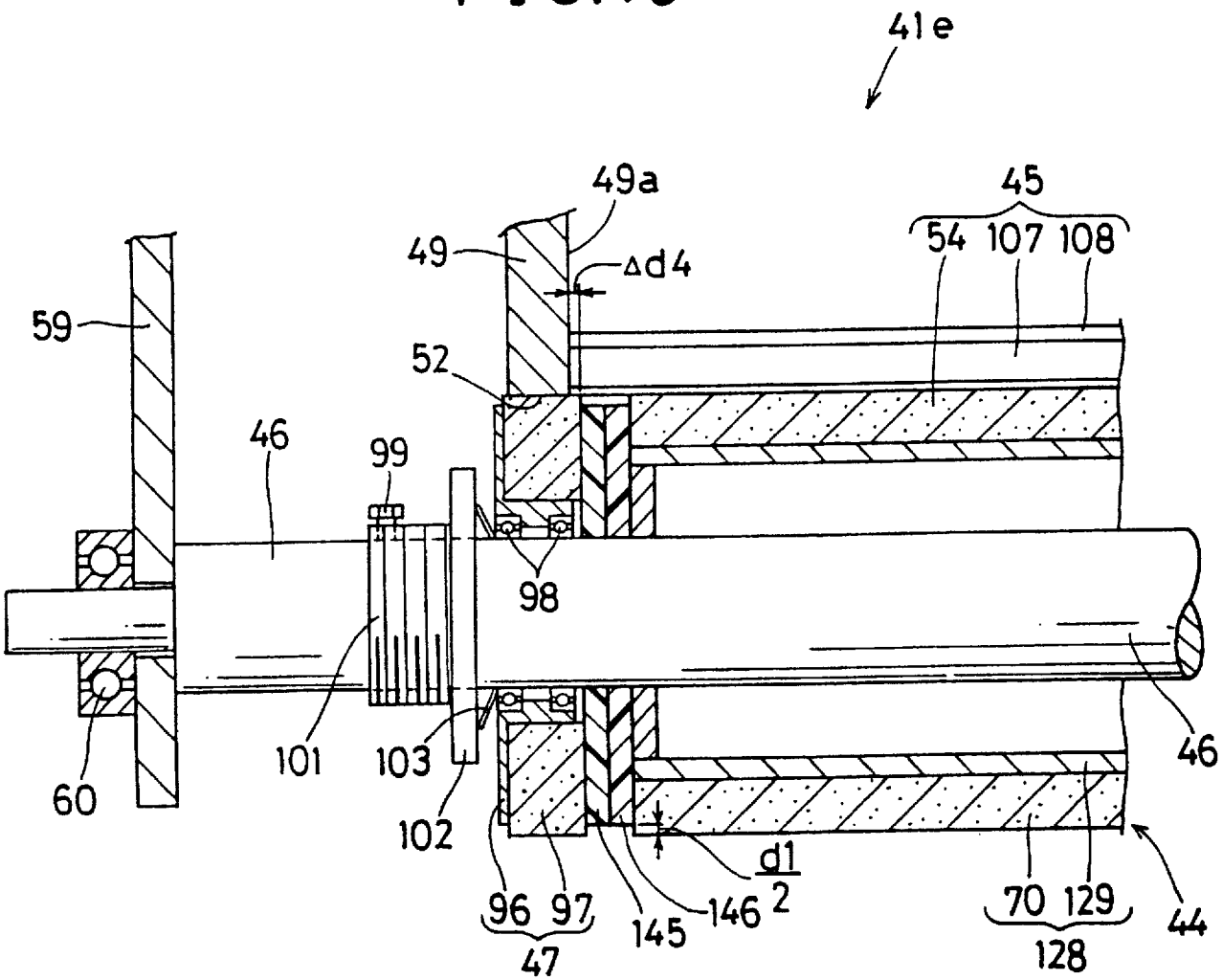
FIG. 10 is a partial enlarged sectional view showing a sealing apparatus in accordance with a still further embodiment of the invention.

FIG. 10 is a partial enlarged sectional view showing a sealing apparatus 41*e* in accordance with a still further embodiment of the invention. The same reference numerals designate the parts corresponding to the above-mentioned embodiments. In the sealing apparatus 41*e* of this embodiment, instead of the rotation disc 56 which is used to isolate, that is, not to transmit the rotation torque of the elastic rotation roll to the seal disc, two slip discs 145, 146 are interposed between the seal disc 47 and the roll body portion 128. The outer diameters of the slip discs 145, 146 are selected to have dimensions slightly smaller by $\Delta d1$ than the outer diameters of the roll body portion 128 and the seal disc 47. In addition, the central portions of the slip discs 145, 146 are provided with through holes in which the roll shaft 46 of the elastic rotation roll 44 is inserted. The slip discs 145, 146 are overlaid with each other.

These slip discs 145, 146 are made of a hard-to-wear material having a small coefficient of dynamic friction at mutual contacting surfaces, for example, (a) fluororesin such as polytetrafluoroethylene resin being formed in a sheet shape, (b) resin mainly consisting of fluororesin, such as polytetrafluoroethylene resin, including glass fiber, graphite, glass fiber and molybdenum disulfide, glass fiber and graphite, bronze, or carbon fiber as a filling material for enhancing wear resistance, rigidity and conductivity (trade name: Exelite), and being formed in a sheet shape, (c) only fluororesin or fluororesin including a filling material, which is coated, sprayed or baked on all surfaces including the inner peripheral and outer peripheral surfaces and both side surfaces of each metal sheet and formed in a sheet shape, (d) only fluororesin or fluororesin including a filling material, which is formed in a sheet shape by coating, spraying or baking and attached to both side surfaces each of metal sheet, (e) ultra-high-molecular-weight polyethylene (trade name: Newlite) being formed in a sheet shape.

As described above, the outer diameters of the slip discs 145, 146 are slightly, for example, by at least the maximum thickness $\Delta T$ of the metal strip 42, smaller than those of the roll body portion 128 and the seal disc 47. The outer diameters of the slip discs 145, 146 are made smaller because of the following reason. When each elastic rotation roll 44 is pushed against each elastic pad 45 and the metal strip 42, the outer peripheral surface of each elastic rotation roll 44 deforms, the outer diameter of the roll becomes smaller, and the distance between the roll shafts 46 is shortened. At this time, the slip discs 145, 146 disposed on one elastic rotation roll 44 do not contact the slip discs disposed on the other elastic rotation roll 44 so as to allow the roll shafts 46 of the elastic rotation rolls 44 to come closer to each other, thereby maintaining the sealing performance between the elastic rotation rolls 44.

Furthermore, the slip discs 145, 146 are always subjected to friction by the rotation of the elastic rotation roll 44 and softened because of frictional heat. A variety of filling materials described above may be added to enhance the rigidity and wear resistance of the discs. When polytetrafluoroethylene resin is used as it is, there is a danger of causing sparks due to increased electrification. Consequently, carbon may be added as a filing material so as to offer conductivity corresponding to a specific electric resistance in the range of 1 to $10^7$ $\Omega\cdot$cm.

Although the vertical bright annealing furnace 43 is explained as an atmosphere facility in the above-mentioned embodiments, a horizontal bright annealing furnace may be used. Furthermore, the atmosphere facility is not limited to bright annealing facilities but a continuous vacuum evaporation furnace may be used. Additionally, organic solvent handling facilities, such as continuous painting apparatuses and cleaning apparatuses operated under reduced pressure lower than atmospheric pressure, may be used. In particular, since stable rotation resistance is obtained in a bright annealing furnace, the tension control of the metal strip being red-hot in the furnace is not disturbed and the tension of the metal strip 42 in the furnace is made stable. Therefore, operation is possible at a proper constant tension, thereby being capable of improving the shape of the metal strip 42 after heat treatment and also capable of enhancing the quality of the metal strip.

Figure 11:
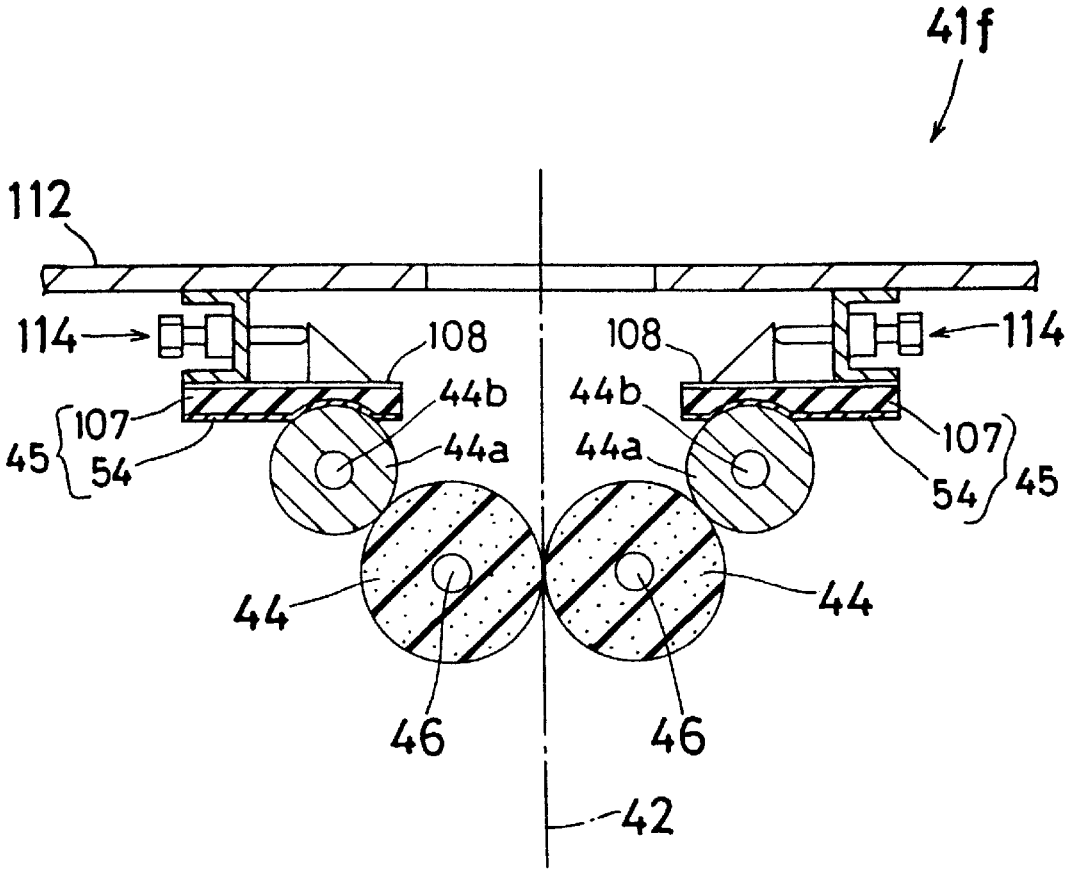
FIG. 11 is a partial enlarged sectional side view showing a sealing apparatus in accordance with a yet still further embodiment of the invention.
Figure 12:
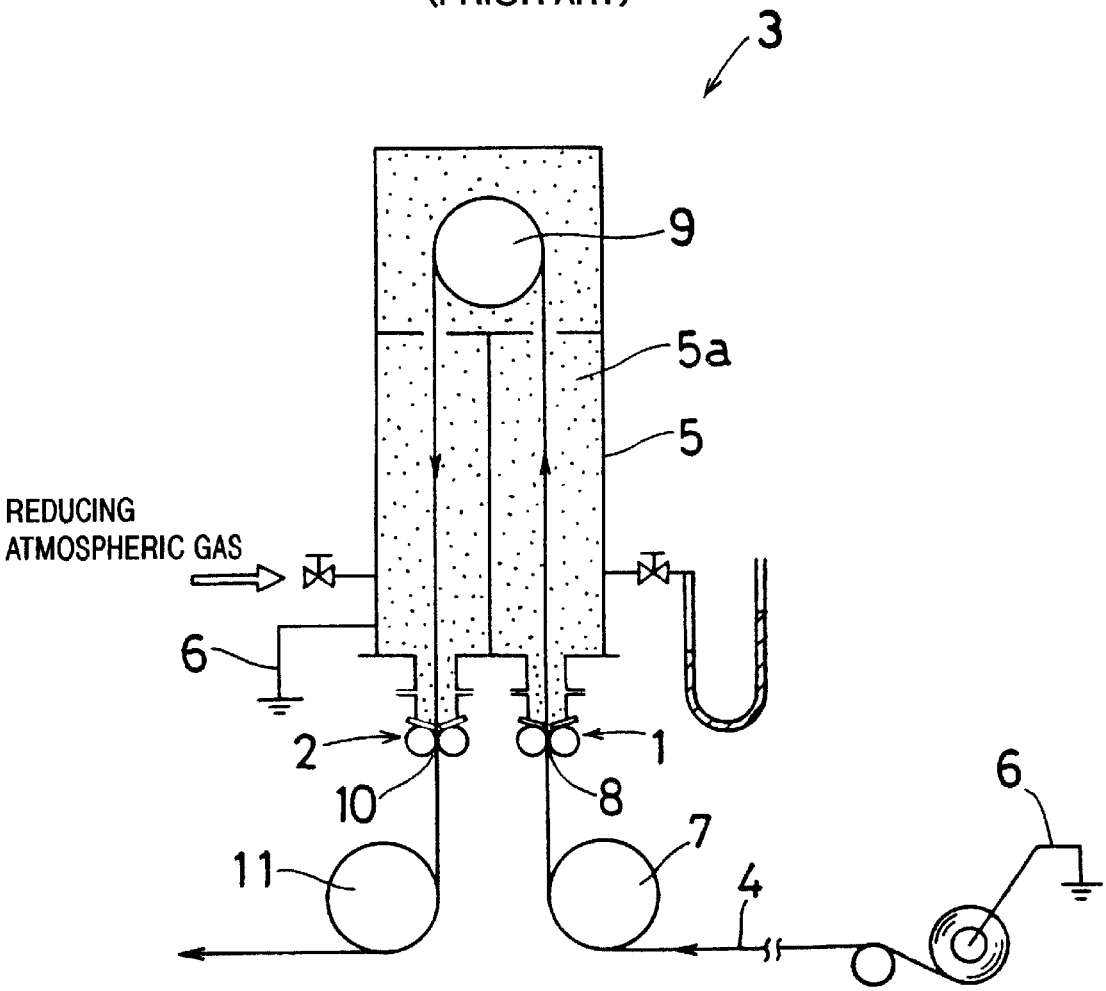
FIG. 12 (PRIOR ART)
FIG. 12 is a schematic sectional view showing a bright annealing furnace equipped with conventional sealing apparatuses.
Figure 13:
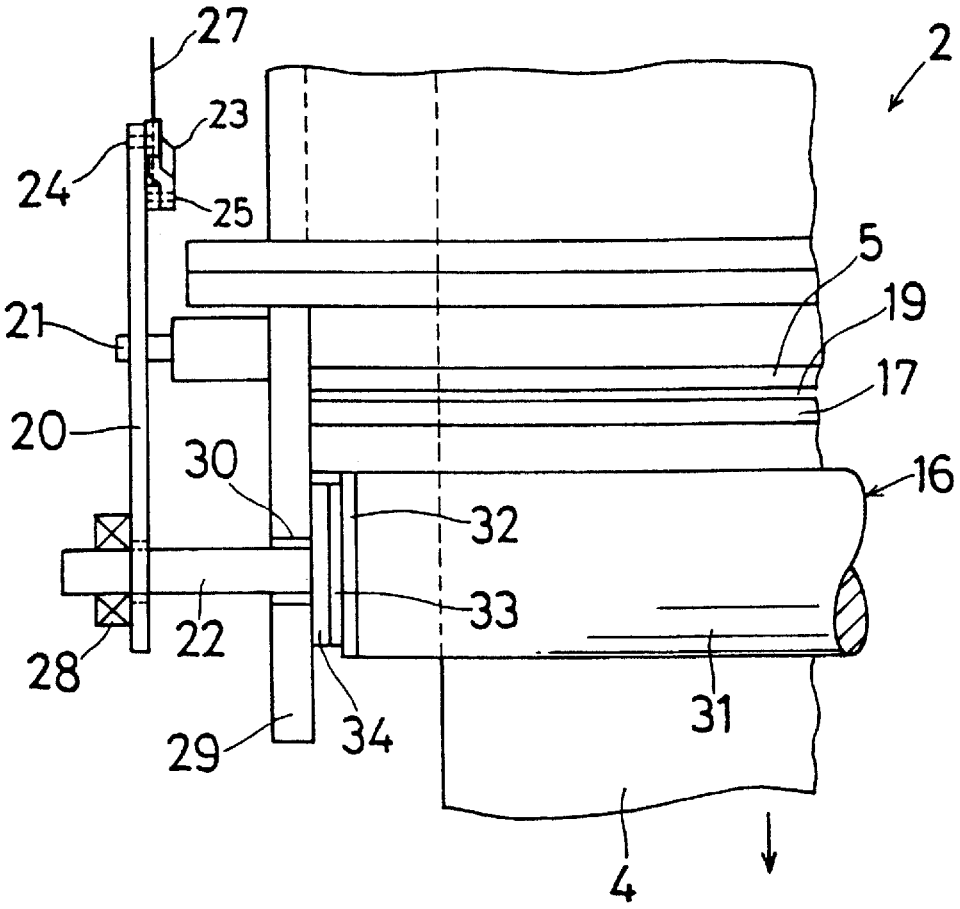
FIG. 13 (PRIOR ART)
FIG. 13 is a partial enlarged front view showing the sealing apparatus shown in FIG. 12.
Figure 14:
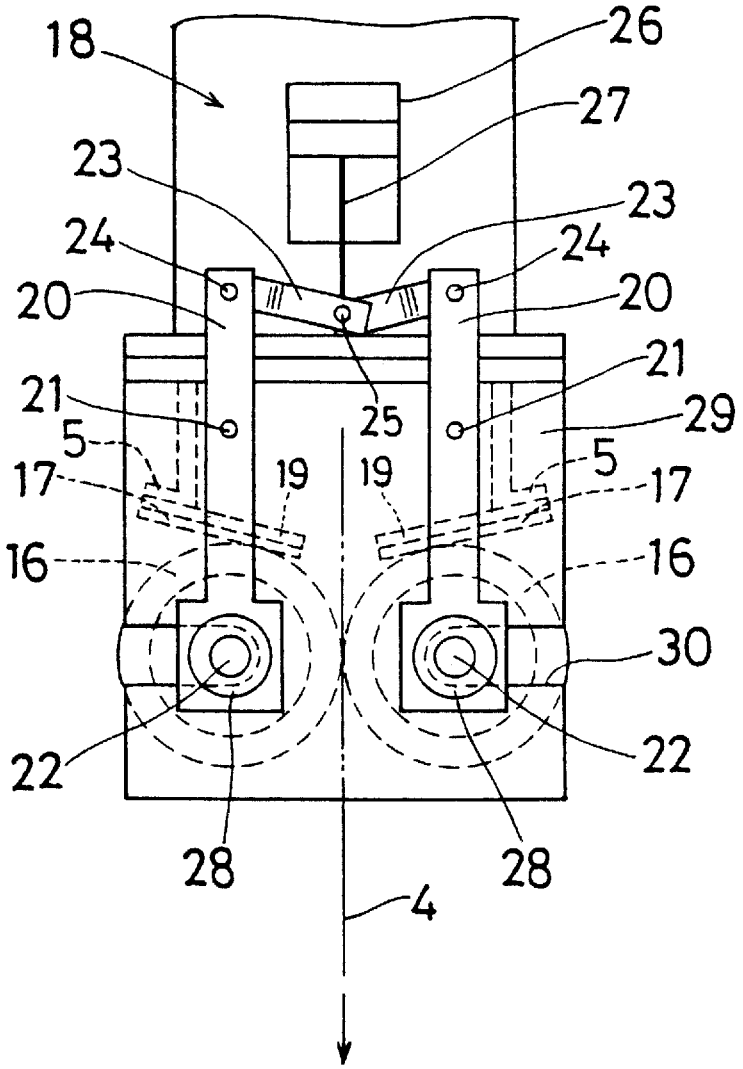
FIG. 14 (PRIOR ART)
FIG. 14 is a left side view of FIG. 13.

FIG. 11 is a partial enlarged sectional view showing a sealing apparatus 41*f* in accordance with a yet still further embodiment of the invention. The same reference numerals designate the parts corresponding to those used in the above-mentioned embodiments. In the sealing apparatus 41*f* of this embodiment, to completely prevent the nonwoven fabric of the surface layer portion 54 of the elastic pad 45 from being fluffed or the fibers of the nonwoven fabric from falling out because of friction with the elastic rotation roll 44, a rigid roll 44*a* having a smooth surface with a small coefficient of friction with the nonwoven fabric of the surface layer portion 54 of the elastic pad 45 is used in combination with the elastic pad 45, without directly contacting the elastic rotation roll 44 with the elastic pad 45.

The surface of the rigid roll 44*a* is made of a hard material such as metal. More specifically, the surface is made of a chrome-plated layer, a tungsten carbide flame-sprayed layer or a stainless steel and finished to a very smooth surface rated at Ra 1.6a, Rmax 6.3S and RZ 6.3Z or less as ▽▽▽ specified in JIS B0031 (1982). When the surface layer portion 54 of the elastic pushing member has a covering layer made of a nonwoven fabric, even when the rigid roll 44*a* contacts the nonwoven fabric while rotating and sliding, the coefficient of friction therebetween is very small. For example, as a result of actual measurement, it is confirmed that the coefficient of friction between a chrome-plated layer and a nonwoven fabric is nearly equal to 0.05, although the coefficient of friction between rubber and a nonwoven fabric is nearly equal to 0.5. Therefore, even when the nonwoven fabric is pushed firmly, the fibers of the nonwoven fabric do not fall out or the nonwoven fabric is not fluffed. Since the surface of the rigid roll 44*a* is conductive and grounded via a roll shaft 44*b* or the like, there is no electrification of static electricity. Even if the surface is made of an insulator, the electrification potential is very low and no problem occurs. Furthermore, even if the surface of the rigid roll 44*a* made of a hard material such as metal is firmly pushed by the elastic pad 45, the surface of the rigid roll 44*a* is not scratched by the fibers of the nonwoven fabric. Besides, both the rigid roll 44*a* and the surface layer portion 54 are not worn much in friction. Moreover, the rotation discs 56, the slip rings 145, 146, the seal discs 47, the pushing devices 57 and the sealing side walls 49 used with the elastic rotation roll 44 can also be used with the rigid roll 44*a* in the same way. Additionally, as the roll open/close device 53, a mechanism (not shown) similar to that for the elastic rotation roll 44 can also be used. Consequently, stable sealing can be coextened for an extended period of time by firmly pushing the rigid roll 44*a* and the elastic pad 45.

As described above, according to the invention, the rotation discs or the slip discs are mounted at both ends of each elastic rotation roll in the axial direction thereof, the seal discs are disposed axially outward from the rotation discs or the slip discs, the outer peripheral surfaces of the seal discs are closely contacted with the sealing side walls, and the elastic pads are pushed against the elastic rotation rolls and the outer peripheral surfaces of the rotation discs or the slip discs so as to form the sealing apparatus. In the prior art, sealing at both ends of the elastic rotation roll is obtained by confining the elastic forces of the rubber washers within a predetermined dimension between the side walls opposed with each other and secured to the furnace body. In the case of the invention, however, it is not necessary to confine such elastic forces. Accordingly, sealing is possible without constraining the movement of the elastic rotation roll in the axial direction thereof at a force more than necessary for sealing.

The following effects can be obtained by the seal disc of the invention.

(1) Since the movement of the elastic rotation roll in the axial direction thereof is not constrained by the side walls even when thermal expansion occurs at the elastic rotation roll, unlike the prior art the roll can expand and contract as desired in the axial direction without causing any change in pushing forces to the side walls, without excessively increasing rotation resistance and without generating any clearance at the time of contraction. The sealing performance of the sealing apparatus of the invention is thus not lowered.

(2) In the case of the prior art, when the elastic rotation roll receives a thrust force in one direction because of the snaking of the metal strip and the shaft of the elastic rotation roll is displaced, the elastic rotation roll is pushed against the side wall and the rotation resistance of the elastic rotation roll becomes excessively high and the speed of the roll is reduced. When the speed reduction occurs at the inlet side sealing apparatus, the tension of the metal strip in the furnace becomes excessively high, and when the speed reduction occurs at the outlet side sealing apparatus, the tension becomes excessively low, and the shape of the red-hot metal strip in the furnace may be damaged. On the other hand, at the opposite side wall, the pushing forces applied from the elastic washers to the side wall are reduced and a clearance is generated, thereby lowering the sealing performance. In the invention, since the seal discs on the side surfaces of the elastic rotation roll are mounted on the shaft of the elastic rotation roll and are moved together with the shaft, the rotation resistance of the roll is not changed and no clearance is generated on the opposite side wall even when the elastic rotation roll receives a thrust force in one direction because of the snaking of the metal strip, thereby ensuring high sealing performance.

(3) In the prior art, when the slip discs are used as means for isolating the rotation torque of the elastic rotation roll, the slip discs become thinner because of wear and a clearance may be generated if the amount of wear exceeds the expansion allowance for the elastic washers. In the invention, the amount of wear is compensated for by the pushing force of the spring used as a pushing device so as not to generate any clearance. In addition, the pushing force can be changed easily by adjusting the nut of the pushing device without removing the elastic rotation roll. Consequently, stable operation is made possible without lowering the sealing performance.

(4) In addition to performing positional adjustment by using the thread and nut of the pushing device, since the roll is pushed via the spring, various spring constant can be selected. Although only one spring is used, the spring output can be set as desired by the adjustment of the thread and nut. Accordingly, since a pushing force appropriate for sealing can be selected as desired, the sealing performance can be adjusted easily.

(5) In the prior art, the elastic rotation roll is installed in a space having a predetermined dimension between the opposed side walls secured to the furnace body while accurately considering the thicknesses of the elastic washers and the like. It is necessary to determine the axial position of the elastic rotation roll and to secure the roll so that the elastic forces of the elastic washers are equally generated at both ends of the elastic rotation roll in the axial direction thereof. This is troublesome and requires skills. In the invention, since the thickness of the seal disc is larger than the width of the sealing side wall, as long as the position of the seal disc is roughly aligned with the position of the sealing side wall, the sealing between the seal disc and the contact surface can be maintained even when the seal disc is axially displaced. Even after the elastic rotation roll is installed, the optimal position of the seal can be obtained as desired for each end of the elastic rotation roll by adjusting the position of the threaded cylindrical body of the pushing device and by also adjusting the thread and nut. This requires no effort or special skills.

(6) In the case of the elastic rotation roll made by stacking the nonwoven fabric discs, each nonwoven fabric disc will contract as the disc is used for an extended period of time, and the nut for securing the flange is required to be tightened additionally. In this case, the length of the body portion of the elastic rotation roll is shortened, and the cover and the rotation disc are moved inward. At this time, the position of the threaded cylindrical body of the pushing device and the thread and nut can be used for adjustment within the range wherein the seal disc closely contacts the contact surface of the sealing side wall. Therefore, the cover and the rotation disc are not required to be replaced but can be used as they are. The service life of the elastic rotation roll can thus be extended, thereby increasing economy.

Furthermore, according to the invention, since the outer peripheral surface of the elastic rotation roll has conductivity corresponding a specific electric resistance in the range of 1 to $10^7$ Ω·cm, spark discharge due to electrification of static electricity can be prevented. Since fires can thus be prevented, a production stop is not necessary for fire extinguishing work and repair work after fire extinguishing, thereby preventing the production capability from lowering.

Furthermore, according to the invention, since the elastic body of the seal disc and the elastic body of the elastic rotation roll are made of a material selected from among natural rubber, isoprene rubber, SBR, NBR, CR, butyl rubber, polysulfide rubber, silicone rubber, fluororubber, urethane rubber, chlorosulfonated polyethylene, chlorinated polyethylene, butadiene rubber, EPDM, acrylic rubber and hydrin rubber, the elastic bodies have appropriate elasticity and have no ventilating performance. Therefore, by closely contacting the elastic bodies with the surface of the metal strip, the sealing performance can be enhanced. Accordingly, the volume of atmospheric gas consumed is less, thereby increasing economy. Moreover, since the metal strip is not oxidized or discolored by the outside air, the quality of the metal strip can be enhanced.

Furthermore, according to the invention, the outer peripheral surface of the elastic rotation roll is made of a plurality of stacked nonwoven fabric discs or a spirally wound and overlaid long nonwoven fabric band. Since this kind of nonwoven fabric has a larger coefficient of dynamic friction with the metal strip as compared with rubber or the like, a slip between the nonwoven fabric and the metal strip hardly occurs, thereby preventing the surface of the metal strip from being damaged.

Furthermore, according to the invention, since the nonwoven fabric has conductivity corresponding to a specific electric resistance in the range of 1 to $10^7$ Ω·cm, spark discharge due to static electricity can be prevented and the safety of operation can be enhanced.

Furthermore, according to the invention, since the outer and inner bearings of the rotation disc relieve the loads caused by the rotation of the elastic rotation roll in the radial and thrust directions thereof, the elastic rotation roll can be rotated smoothly. Even when the elastic rotation rolls are closely and firmly contacted with the metal strip, the rotation resistance of the rolls does not increase. Therefore, the sealing performance can be enhanced without adversely affecting the tension of the metal strip in the furnace. Moreover, since the transmission of the rotation force of each elastic rotation roll can be shut off while sealing the atmospheric gas in the furnace between the seal discs and both ends of the elastic rotation roll in the axial direction thereof, the outside air can be prevented from entering the furnace. Therefore, the bright annealing furnace can be operated at a low dew point, and high-quality products having high brightness can be produced.

Furthermore, according to the invention, since an inclined face is formed on the third flange portion of the second supporting member of the rotation disc so that the diameter of the third flange portion is reduced outwardly in the axial direction of the roll body, the elastic material of the end face sealing member can be integrally formed up to the thin wall portion at the outer peripheral tip of the flange portion, and the outer diameter of the flange portion opposite to the tip of the outer covering member can be made as large as the outer diameter of the sliding ring. The outer peripheral portion of the end face sealing member made of an elastic material is pushed and enters the space formed by the outer peripheries of the sliding rings, the end faces of the outer covering members and the thin wall portions at the outer peripheral tips of the flange portions of the end face sealing members of the opposed elastic rotation rolls, thereby being capable of attaining high sealing performance. Therefore, less of the expensive atmospheric gas will be consumed and the production costs can be reduced.

Furthermore, according to the invention, since the outer covering member and the end face sealing member of the rotation disc have a specific electric resistance in the range of 1 to $10^7$ Ω·cm, even when static electricity is apt to be generated because of separation or deformation caused by the rotation between the rotation discs and between the end face sealing members of the elastic rotation rolls facing each other, or even when continuous sliding friction occurs between the elastic pads and the elastic rotation rolls, electrification due to static electricity can be prevented and the spark discharge can be also prevented, thereby being capable of performing stable operation without the fear of fires and explosions.

Furthermore, according to the invention, since the elastic pad, at least the surface layer portion thereof contacting the elastic rotation roll, is made of a nonwoven fabric, and the elastic pad is as a whole an elastic body having a hardness in the range of 10° to 50° as a value specified in JIS S 6050, the elastic pad has appropriate flexibility. The elastic pad can thus be pushed uniformly over the entire surface, and can fit well with the uneven surface of the elastic rotation roll. Consequently, the elastic pad can ensure high sealing performance without damaging the soft covering of the elastic rotation roll. As a result, less of the atmospheric gas is consumed and the rolls are less damaged.

Furthermore, according to the invention, since the elastic pad, at least the surface layer portion thereof contacting the elastic rotation roll, has a specific electric resistance in the range of $10^{-3}$ to $10^{7}$ Ω·cm, even when static electricity is generated by friction, deformation or separation of the covering due to the contact and rotation between the elastic rotation rolls, or by friction between the elastic rotation roll and the elastic pad, no spark discharge is generated, and electrification can be prevented by grounding or corona discharge, thereby preventing fires and explosions. Consequently, a production stop due to fires can be prevented and the safety of operation can be ensured.

Furthermore, according to the invention, since the elastic pad, at least the surface layer portion thereof contacting the elastic rotation roll, is made of a material having a limit oxygen index (LOI) value of 26 or more, in case a fire occurs at the sealing portion and the fire is extinguished in a short time of about 10 seconds, the material does not melt or drop, and does not burn continuously because of its self-extinguishing characteristic. Therefore, the sealing performance is not lowered and operation can be resumed immediately. The influence of a production stop can be minimized and productivity can be enhanced.

The elastic rotation roll in which the roll body portion and the roll shaft are made rotatable with respect to each other has the following effects.

(1) Since the roll shaft does not rotate but is secured, the weight of the rotation portion can be reduced. In addition, the rotation disc incorporating bearings is combined to seal the end face of the elastic rotation roll. Therefore, the rotation resistance of the rotation portion is smaller and the inertial force ($GD^2$) of the rotation portion during rotation is also smaller. For these reasons, the elastic rotation rolls can be rotated by the metal strip being passed through a process line even when a motor used as an energizing device and a control unit for controlling the acceleration/deceleration of the motor are not provided. The structure can thus be used for sealing. When a motor used as an energizing device is installed, the inertial force of the motor itself or a reduction gear attached to the motor is large in some cases. In the prior art, the metal strip being passed through a process line is disturbed if controlled improperly. Such disturbance does not occur in the case of the invention. Besides, the structure of the invention is simple and low in cost.

(2) Since a motor used as an energizing device and a reduction gear attached to the motor is not required, the apparatus can be made smaller.

(3) Since the roll shaft does not rotate but is secured, the pushing devices mounted on both sides of the roll shaft can be adjusted even during the operation of a process line. In addition, the pushing force applied to the end face of the seal disc can be increased or decreased by tightening or loosening the spring during the operation of the process line. Consequently, the sealing apparatus can be adjusted optimally without stopping production in the process line.

What is claimed is:

1. A sealing apparatus for an inlet and/or outlet of a furnace body of an atmosphere facility through which a metal strip is continuously passed for atmosphere-treating the metal strip by using an atmospheric gas, said sealing apparatus comprising a pair of elastic rotation rolls for engaging the metal strip, and a pair of elastic pads which are biased against said elastic rotation rolls, respectively, over an entire length thereof, each of said elastic rotation rolls comprising:

a roll body including a roll shaft which has a first end portion and a second end portion;

a first seal disc and a second seal disc coaxially mounted via bearings on said first end portion of said roll shaft and said second end portion of said roll shaft, respectively, each of said first and second seal discs including a ring-shaped elastic body or a hollow cylindrical elastic body;

first and second isolating means for isolating rotation of said elastic rotation roll so that rotation torque of said roll body is not transmitted to said first and second seal discs, said first isolating means being disposed between a first end of said roll body and said first seal disc, and said second isolating means being disposed between said second end of said roll body and said second seal disc, wherein outer peripheral surfaces of said elastic bodies of said first seal discs of said elastic rotation rolls are adapted to engage one of a pair of sealing side walls, and outer peripheral surfaces of said elastic bodies of said second seal discs of said elastic rotation rolls are adapted to engage the other of the sealing side walls, so as to form sealed boundaries between said outer peripheral surfaces of said elastic bodies of said first and second seal discs and the furnace body.

2. The sealing apparatus as claimed in claim 1, wherein each of said elastic rotation rolls further comprises:

a first pushing device, provided at said first end portion of said roll shaft, for providing a pushing force against said first seal disc in an axially inward direction; and a second pushing device, provided at said second end portion of said roll shaft, for providing a pushing force against said second seal disc in an axially inward direction.

3. The sealing apparatus as claimed in claim 2, wherein each of said first and second pushing devices comprises:

a spring mounted on said roll shaft;

a cylindrical body adjustably mounted on said roll shaft, said cylindrical body being positioned outwardly, in an axial direction, relative to said corresponding seal disc, said cylindrical body having a threaded section on an outer periphery thereof; and a nut screwed on said threaded cylindrical body for supporting said spring.

4. The sealing apparatus as claimed in any one of claims 1 to 3, wherein said elastic body of each seal disc is formed of a material or a plurality of materials selected from the group consisting of silicone rubber, fluororubber, chloroprene rubber, styrene-butadiene rubber, nitrile-butadiene rubber, ethylene-propylene rubber, urethane rubber, isoprene rubber, butyl rubber, polysulfide rubber, chlorosulfonated polyethylene, chlorinated polyethylene, butadiene rubber, acrylic rubber and hydrin rubber, and said elastic body has a hardness in the range of 40° to 90° as a value specified in JIS K 6301 A.

5. The sealing apparatus as claimed in any one of claims 1 to 3, wherein each of said elastic bodies of said first and second seal discs has an axial length which is greater, in at least an axially inward direction, than a width of the sealing sidewalls along an axial direction of said first and second seal discs.

6. The sealing apparatus as claimed in any one of claims 1 to 3, wherein each of said roll bodies of said elastic rotation rolls includes an elastic covering layer which is formed of a material or a plurality of materials selected from the group consisting of natural rubber, isoprene rubber, styrene-butadiene rubber, nitrile-butadiene rubber, chloroprene rubber, butyl rubber, polysulfide rubber, silicone rubber, fluororubber, urethane rubber, chlorosulfonated polyethylene, chlorinated polyethylene, butadiene rubber, ethylene-propylene rubber, acrylic rubber and hydrin rubber, and said elastic covering layer has a hardness in the range of 40° to 90° as a value specified in JIS K 6301 A.

7. The sealing apparatus as claimed in any one of claims 1 to 3, wherein said roll body of each of said elastic rotation rolls is integrally formed by cylindrically coating an outer peripheral surface of said roll shaft with an elastic layer, of which at least the outer surface has a specific electric resistance in the range of 1 to $10^7$ Ω·cm in the longitudinal direction of the outer peripheral surface of said roll shaft.

8. The sealing apparatus as claimed in claim 7, wherein said nonwoven fabric, of said covering layer, is a nonwoven fabric which includes fibers mixed with carbon, or a nonwoven fabric using fibers made by chemically forming polypyrrole which is an electron-conjugated conductive polymer, or a nonwoven fabric using fibers produced by treating acrylic fibers with a compound including a divalent copper compound and sulfur, each being a conductive nonwoven fabric having a specific electric resistance in the range of 1 to $10^7$ Ω·cm.

9. The sealing apparatus as claimed in any one of claims 1 to 3, wherein said roll body of each of said elastic rotation rolls comprises:

a covering layer which is integrally formed on an outer peripheral surface of the roll shaft by stacking a plurality of nonwoven fabric discs or by spirally winding and overlaying a long nonwoven fabric band on said outer peripheral surface of said roll shaft along the longitudinal direction thereof;

a first flange provided on said roll shaft adjacent a first axial end face of said covering layer;

a second flange provided on said roll shaft adjacent a second axial end face of said covering layer, wherein said first and second flanges engage said first and second layer end faces, respectively, so as to integrate and secure said stacked nonwoven fabric discs or said overlaid nonwoven fabric band;

a first cylindrical cover provided on said roll shaft outwardly of said first flange in an axial direction of said roll shaft, wherein said first cylindrical cover includes an elastic outer layer having an axial inner end in engagement with said first flange and an axial outer end in engagement with said roll shaft;

a second cylindrical cover provided on said roll shaft outwardly of said second flange in an axial direction of said roll shaft, wherein said second cylindrical cover includes an elastic outer layer having an axial inner end in engagement with said first flange and an axial outer end in engagement with said roll shaft.

10. The sealing apparatus as claimed in claim 9, wherein said nonwoven fabric, of said covering layer, is a nonwoven fabric which includes fibers mixed with carbon, or a nonwoven fabric using fibers made by chemically forming polypyrrole which is an electron-conjugated conductive polymer, or a nonwoven fabric using fibers produced by treating acrylic fibers with a compound including a divalent copper compound and sulfur, each being a conductive nonwoven fabric having a specific electric resistance in the range of 1 to $10^7$ Ω·cm.

11. The sealing apparatus as claimed in claim 9, wherein each of said elastic rotation rolls further comprises:

a first rotation disc provided between a first end said covering layer and said first seal disc; and a second rotation disc provided between a second end said covering layer and said second seal disc, wherein each of said first and second rotation discs comprises:

an outer covering member made of an elastic material and having a first flange portion, contacting the end face of said corresponding second flange of said roll body, and a first cylindrical portion extending outward in the axial direction of said roll shaft from an outer peripheral portion of said first flange portion;

a first supporting member made of a rigid material, said first supporting member having a second flange portion contacting an outer surface of said first flange portion and a second cylindrical portion extending outward in the axial direction of said roll shaft from an outer peripheral portion of said second flange portion;

a second supporting member made of a rigid material, said second supporting member having a third cylindrical portion interposed between said roll shaft and said second cylindrical portion and extending outwardly in the axial direction of said roll shaft from said second flange portion, and a third flange portion extending in a radial direction of said roll shaft from an axially outward end portion of said third cylindrical portion;

an outer bearing interposed between said third cylindrical portion and said second cylindrical portion, said outer bearing receiving radial and thrust forces;

an inner bearing interposed between said third cylindrical portion and said roll shaft; and an end face sealing member, formed of an elastic material, interposed between said corresponding seal disc and said third flange portion of said second supporting member.

12. The sealing apparatus as claimed in claim 11, wherein said outer covering layer and said end face sealing member are formed of an elastic material having a specific electric resistance in the range of 1 to $10^7$ Ω·cm.

13. The sealing apparatus as claimed in claim 11, wherein said second supporting member includes an inclined face formed on an outer periphery of said third flange portion such that the diameter of the third flange portion decreases outwardly in the axial direction of said roll shaft.

14. The sealing apparatus as claimed in claim 13, wherein said outer covering layer and said end face sealing member are formed of an elastic material having a specific electric resistance in the range of 1 to $10^7$ Ω·cm.

15. The sealing apparatus as claimed in any one of claims 1 to 3, wherein each of said elastic pads is made of a nonwoven fabric in at least a surface layer portion which contacts one of said elastic rotation rolls, and constitutes, as a whole, an elastic body having a hardness in the range of 10° to 50° as a value specified in JIS S 6050.

16. The sealing apparatus as claimed in any one of claims 1 to 7, wherein each of said elastic pads has a specific electric resistance in the range of $10^{-3}$ to $10^7$ Ω·cm in at least a surface layer portion which contacts one of said elastic rotation roll.

17. The sealing apparatus as claimed in any one of claims 1 to 3, wherein each of said elastic pads is formed of a material having an LOI value of 26 or more in at least a surface layer portion which contacts one of said elastic rotation rolls, the LOI being an index of the minimum oxygen volume percentage required for maintaining combustion of fibers.

* * * * *